US010358789B2

(12) United States Patent
Hyder

(10) Patent No.: US 10,358,789 B2
(45) Date of Patent: Jul. 23, 2019

(54) LOADER ATTACHMENT SYSTEM

(71) Applicant: YANMAR CO., LTD., Osaka-shi, Osaka (JP)

(72) Inventor: Jarrod Hyder, Adairsville, GA (US)

(73) Assignee: YANMAR CO., LTD., Osaka (JP)

( * ) Notice: Subject to any disclaimer, the term of this patent is extended or adjusted under 35 U.S.C. 154(b) by 701 days.

(21) Appl. No.: 15/054,646

(22) Filed: Feb. 26, 2016

(65) Prior Publication Data

US 2017/0247854 A1 Aug. 31, 2017

(51) Int. Cl.

| | |
|---|---|
| ***E02F 3/627*** | (2006.01) |
| ***E02F 3/36*** | (2006.01) |
| ***E02F 3/96*** | (2006.01) |

(52) U.S. Cl.

CPC ..... *E02F 3/6273* (2013.01); *E02F 3/3645* (2013.01); *E02F 3/3668* (2013.01); *E02F 3/3672* (2013.01); *E02F 3/3695* (2013.01); *E02F 3/968* (2013.01)

(58) Field of Classification Search

CPC ..... E02F 3/6273; E02F 3/3645; E02F 3/3668; E02F 3/3695; E02F 3/3672; E02F 3/968

See application file for complete search history.

(56) References Cited

U.S. PATENT DOCUMENTS

| | | | | |
|---|---|---|---|---|
| 5,620,297 | A | 4/1997 | Mahaney | |
| 9,267,263 | B2 * | 2/2016 | Bertrand | E02F 3/34 |
| 2006/0245899 | A1 | 11/2006 | Lyons | |
| 2015/0093225 | A1 * | 4/2015 | Bertrand | E02F 3/34 414/686 |

FOREIGN PATENT DOCUMENTS

| | | | |
|---|---|---|---|
| DE | 3517151 | A1 | 11/1986 |
| GB | 2044724 | A | 10/1980 |
| JP | S59043560 | U | 3/1984 |
| JP | H02109854 | U | 9/1990 |

OTHER PUBLICATIONS

Partial European Search Report for corresponding EP Patent Application No. 17157410.6-1712; dated Jul. 20, 2017.

Partial European Search Report for corresponding to EP Patent Application No. 17157410.6-1712; dated Jul. 20, 2017.

* cited by examiner

*Primary Examiner* — Michael S Lowe

(74) *Attorney, Agent, or Firm* — Norton Rose Fulbright US LLP

(57) ABSTRACT

A loader attachment system is configured so as to detachably attach a loader to a vehicle by detachably attaching a mast of the loader to a loader mount fixed on the vehicle. The loader attachment system includes a support device, a location device, and an engagement device. The support device is configured to support the mast on the loader mount so that the mast is rotatable relative to the loader mount. The location device is configured to locate the mast supported on the loader mount by the support device at an attachment position. The engagement device is configured to engage the mast at the attachment position with the loader mount so as to prevent the mast from rotating in a direction to detach the mast from the loader mount. The support device, the location device and the engagement device are configured independent of one another.

18 Claims, 16 Drawing Sheets

LOADER ATTACHMENT SYSTEM

BACKGROUND OF THE INVENTION

Field of the Invention

The present invention relates to a loader attachment system for detachably attaching a loader, e.g., a front end loader, to a vehicle, e.g., a tractor.

Related Art

As disclosed by US 2006/0245899 A1, there is a well-known conventional mechanism configured so that right and left masts of a front end loader is detachably attached to right and left loader mounts previously secured on a tractor so as to detachably attach the front end loader to the tractor. The front end loader includes a pair of right and left arms whose rear ends are pivoted on the respective right and left masts. A working instrument, e.g., a bucket, is attached onto front ends of the arms. An arm cylinder is interposed between each arm and each mast so as to serve as an actuator for rotating the arm relative to the mast.

Each of the masts has an arm cylinder pivot shaft onto which a tip of a piston rod of the arm cylinder is pivoted. A latching arm formed with a hook is also pivotally provided on the arm cylinder pivot shaft. A torsion spring is interposed between the latching arm and the mast. On the other hand, each of the loader mounts includes upper and lower bushed pins. The lower bushed pin serves as a pivot for rotating the mast relative to the loader mount. The upper bushed pin serves as a latched pin onto which the hook of the latching arm is hooked to lock the mast to the loader mount.

To attach the masts of the front end loader (with the bucket) to the loader mounts of the tractor, the front end loader is previously set so that the bucket, mounted on the front end of the front end loader, and a parking stand, extended forward and downward from the masts, are placed on the ground. Then, the tractor approaches the placed front end loader and stops. Hydraulic pipes are provided to fluidly connect the hydraulic actuators of the front end loader to the tractor. An operator seated on the tractor operates to contract piston rods of the arm cylinders so that the lower bushed pins of the loader mounts are received by respective receptacles formed on bottom edges of the right and left masts. Once the lower bushed pins are fitted in the receptacles, the piston rods of the arm cylinders are further contracted to rotate the masts centered on axes of the lower bushed pins relative to the loader mounts so as to lift the parking stand upward apart from the ground. Also, the contraction of the piston rods of the arm cylinders cause overcenter action of the torsion springs and location of the latching arms at their latching positions. Therefore, finally, the latching arms are biased by the torsion springs so as to be hooked on the upper bushed pins of the loader mounts, thereby completing the attachment of the masts of the front end loader to the loader mounts of the tractor.

To detach the masts of the front end loader from the loader mounts, first, the seated operator operates the front end loader to place the bucket on the ground, and the operator operates toe pad portions of the latching arms with his/her foot so as to forcedly disengage the latching arms from the upper bushed pins. In this regard, due to the force of the operator's foot, at first, the latching arm rotates around the axis of the arm cylinder pivot shaft against the force of the torsion spring biasing the latching arm to the latching position. However, once the overcenter action of the spring occurs, the spring comes to bias the latching arm to its unlatching position, where the latching arm abuts against a part of the piston rod of the arm cylinder, thereby easily completing the disengagement of the masts from the loader mounts. Then, the seated operator operates to extend the piston rods of the arm cylinders to rotate the masts relative to the loader mounts so that the receptacles of the masts can easily be separated from the lower bushed pins of the loader mounts.

In this way, the latching of the masts to the loader mounts via the latching arms relies on the telescopic operation of the piston rods of arm cylinders. In other words, the upper bushed pin of each loader mount defines both the latching position of the latching arm and the attachment position of the mast relative to the loader mount. Moreover, both the location of the masts relative to the loader mounts and the latching of the masts to the loader mounts depend on the rotation of the masts relative to the loader mounts centered on the lower bushed pins. Such a structure seems to require a great accuracy in dimensioning of the latching arms in shape and location relative to both the upper and lower bushed pins so as to increase manufacturing costs.

Further, to detach the masts from the loader mounts, an operator, who may sit on the seat or stand on a platform in front of the seat, has to use his/her foot to operate the toe pad portion formed on the rear end portion of each latching arm so as to detach the latching arm from the upper bushed pin. This operation using the operator's foot seems to be laborious. Moreover, this unlocking manner is not adaptable to a cabin tractor because an operator inside of a cabin cannot access a front end loader outside of the cabin. In other words, each latching arm of the front end loader is formed with the toe pad portion suitable for operation by an operator sitting on the seat or standing on the platform, so that it seems to be hard for a person, who stands beside the tractor (i.e., does not ride the tractor), to access and operate the latching arm for unlatching the latching arm from the upper bushed pin. Therefore, to provide a loader attachment system adaptable to a cabin tractor, the loader attachment system should have a structure enabling an operator outside of a cabin to operate for unlocking masts from loader mounts.

SUMMARY OF THE INVENTION

An object of the invention is to provide a reasonable and useful loader attachment system for detachably attaching a mast of a loader, e.g., a front end loader, to a loader mount of a vehicle, e.g., a tractor, especially, a cabin tractor.

To achieve the object, a loader attachment system according to the present invention includes a loader mount fixed on a vehicle, and a mast of a loader to be detachably attached to the loader mount. The loader attachment system further includes a support device, a location device and an engagement device. The support device is configured to support the mast on the loader mount so that the mast is rotatable relative to the loader mount. The location device is configured to locate the mast supported on the loader mount by the support device at an attachment position. The engagement device is configured to engage the mast at the attachment position with the loader mount so as to prevent the mast from rotating in a direction to detach the mast from the loader mount. The support device, the location device and the engagement device are configured independent of one another.

Due to the independency, the support device, the location device and the engagement device can each have a simple and economic structure. Especially, the location device and the engagement device can be simplified because each of them does not have to be configured to have the function of the other.

Preferably, the support device includes a pivot and a receptacle receiving the pivot. The pivot serves as a fulcrum of the rotation of the mast relative to the loader mount. One of the loader mount and the mast includes the pivot, and the other of the loader mount and the mast includes the receptacle. The location device includes a projection and a groove. The groove is extended along a locus of the projection during the rotation of the mast relative to the loader mount. One of the loader mount and the mast includes the projection, and the other of the loader mount and the mast includes the groove. The rotation of the mast relative to the loader mount moves the projection in the groove. A position where the projection abuts against a deep end of the groove is defined as the attachment position.

Therefore, especially, the location device is simplified so that it includes only the projection and the groove because it does not have the function of the engagement device.

Preferably, the engagement device includes a tooth provided on the loader mount, a pawl pivoted on the mast, an overcenter spring interposed between the pawl and the mast, and a release handle pivoted on the mast so that the pawl and the release handle are rotatably centered on a common axis. The release handle is rotatable from a lock position to engage the pawl with the tooth. When the pawl engages with the tooth, the spring biases the pawl in a direction to engage the pawl with the tooth. When the release handle is rotated from the lock position, the pawl rotates around the common axis, and the overcenter spring changes a direction of its force so as to bias the pawl in another direction to rotate the pawl apart from the tooth, thereby keeping the pawl disengaged from the tooth.

Therefore, due to the overcenter action of the spring, the operator's manipulation force can be reduced in both the rotation of the pawl for engaging with the tooth and the rotation of the pawl for disengaging from the tooth. Further, the manipulation of the release handle with the operator's hand is easier than manipulation by use of an operator's foot.

Preferably, when the mast is attached to the loader mount, the release handle is disposed at a right or left outside of the mast.

Therefore, an operator can have a sufficient space for operating the release handle the right or left outside of the mast freely from uneasiness. Especially, if a cabin tractor employs this loader attachment system, an operator outside a cabin can easily access the release handle. Further, if the mast is made of transparent or semitransparent material, the rotational position of the pawl may be further clearly visible.

Preferably, when the mast is attached to the loader mount, the loader is disposed forward or rearward from the vehicle, and the handle-lock position is forward or rearward close to the loader so that the rotation direction of the release handle from the handle-lock position is forward or rearward away from the loader.

Therefore, the lock position and the rotational direction of the release handle are set to match with the operator's sense that defines the direction close to the loader as the direction for locking the mast of the loader, thereby preventing an operator's operational error.

These and other objects, features and advantages of the invention will appear more fully from the following detailed description of the invention with reference to the attached drawings.

DETAILED DESCRIPTION OF THE INVENTION

Figure 1:
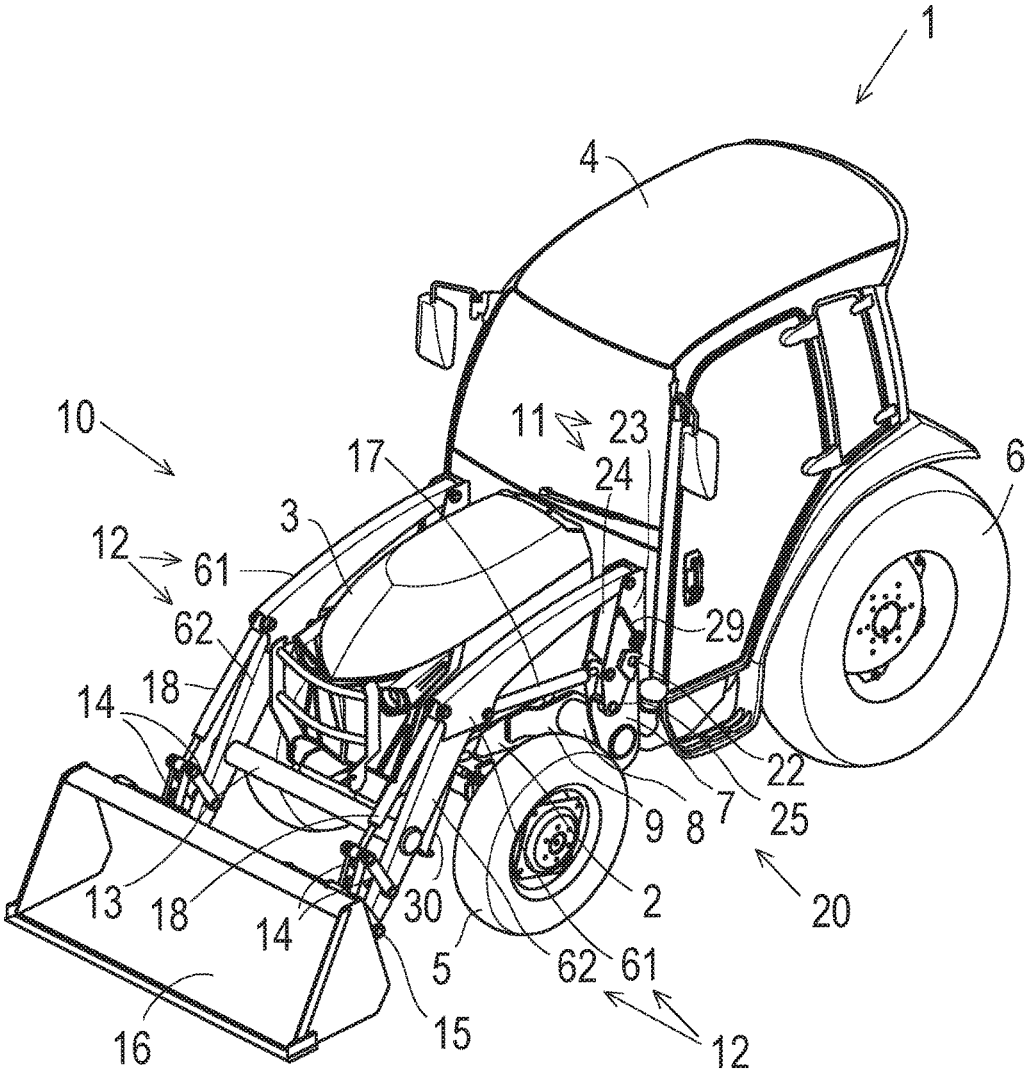
FIG. 1 is a perspective front view of a tractor equipped with a front end loader by a loader attachment system according to the present invention.
Figure 2:
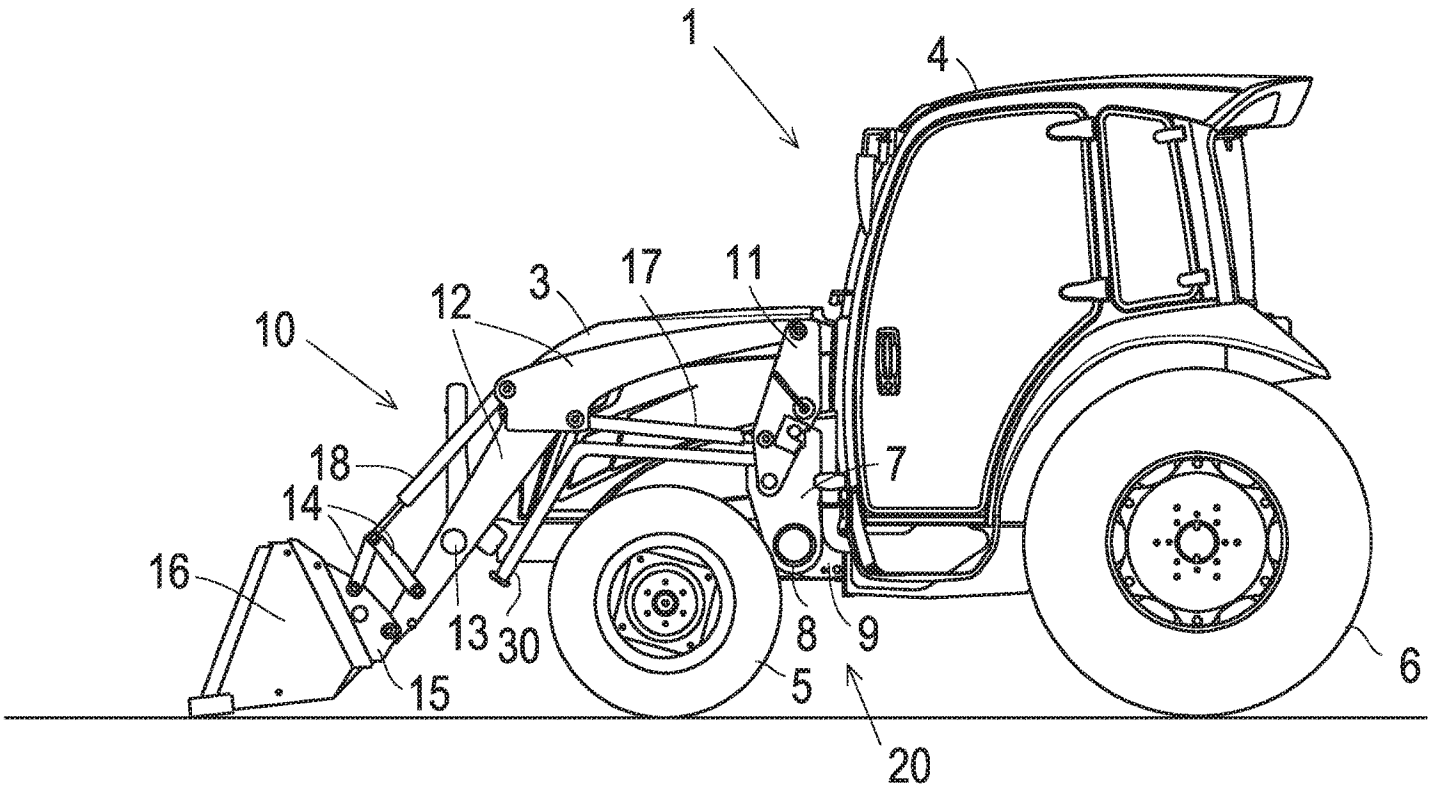
FIG. 2 is a left side view of the tractor.
Figure 3:
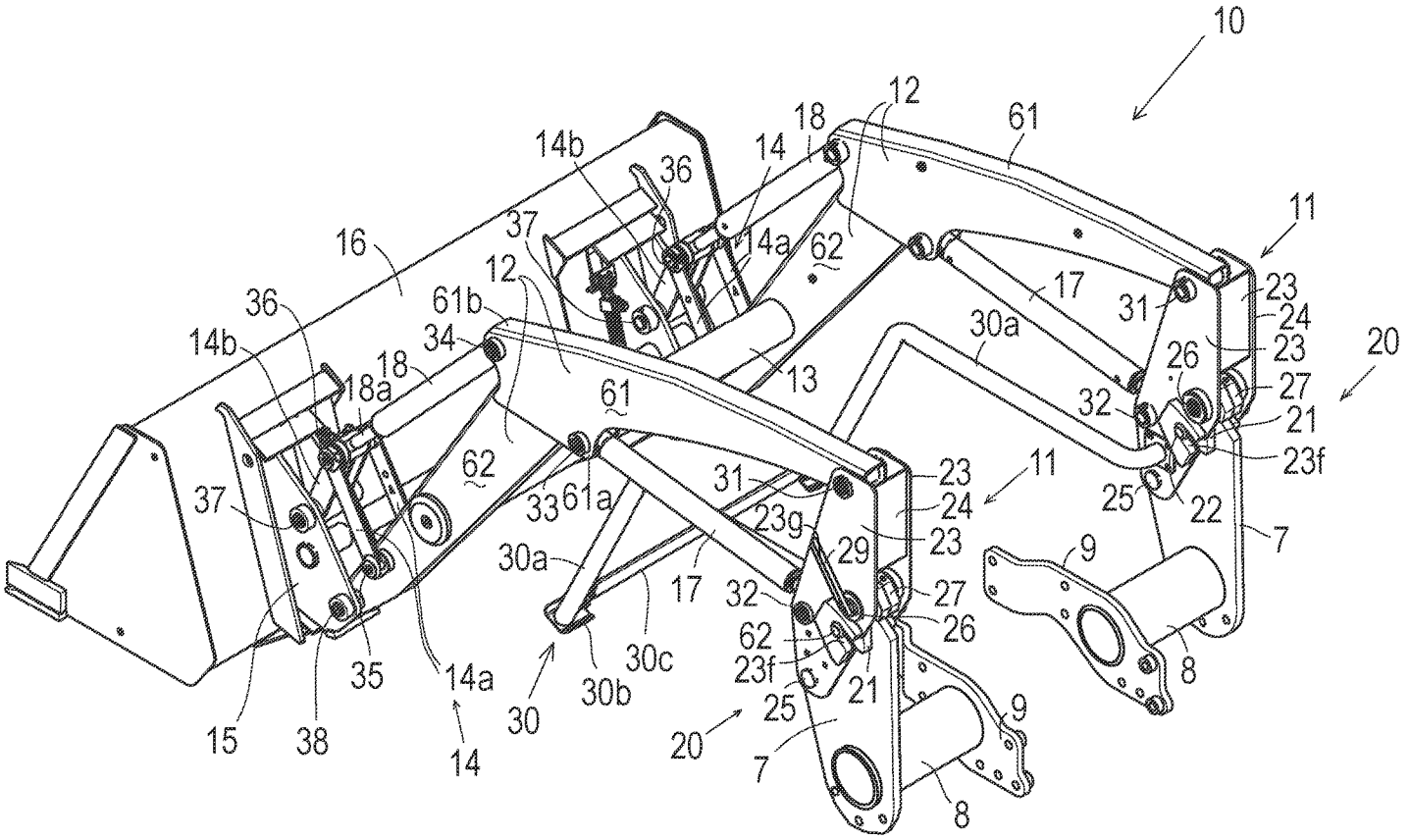
FIG. 3 is a perspective rear view of the front end loader having masts attached to loader mounts by the loader attachment system.
Figure 4:
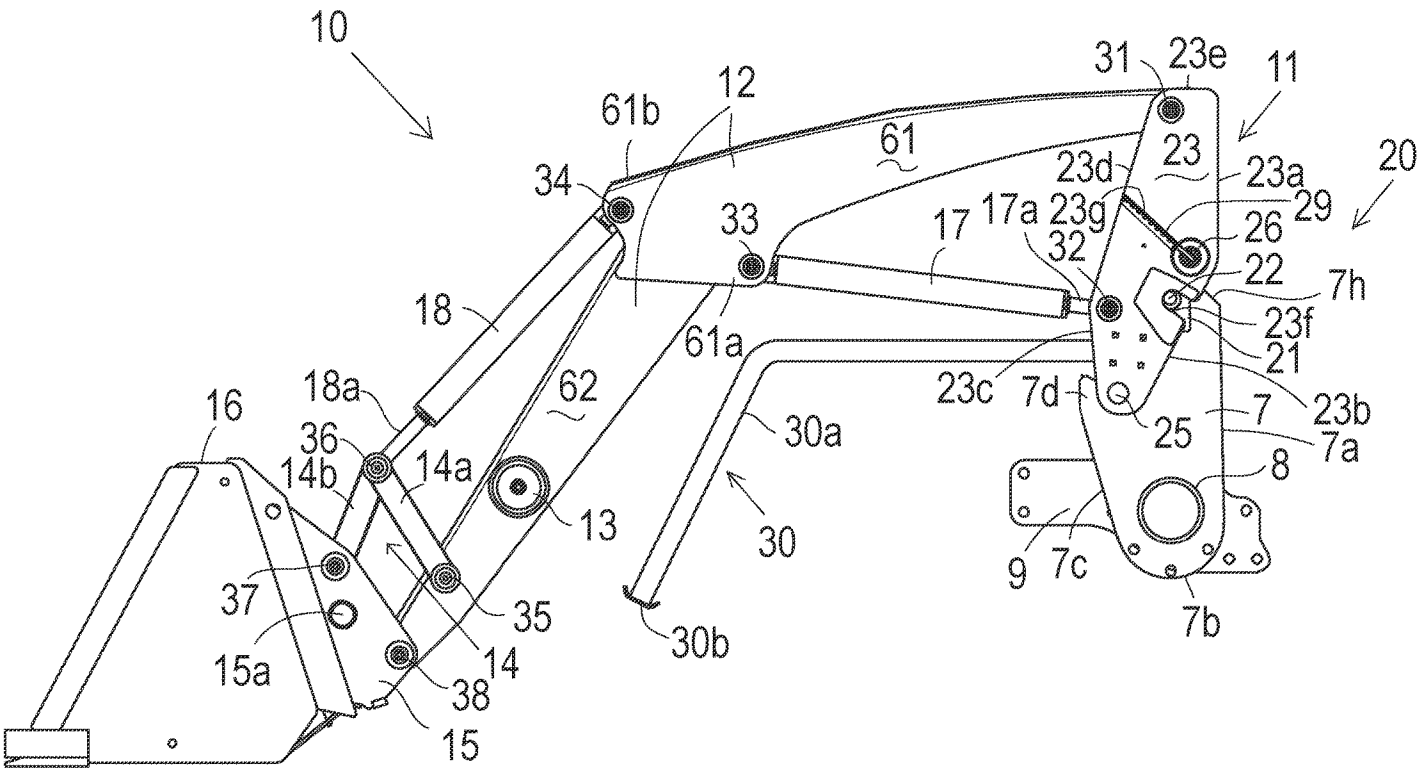
FIG. 4 is a left side view of the front end loader.
Figure 5:
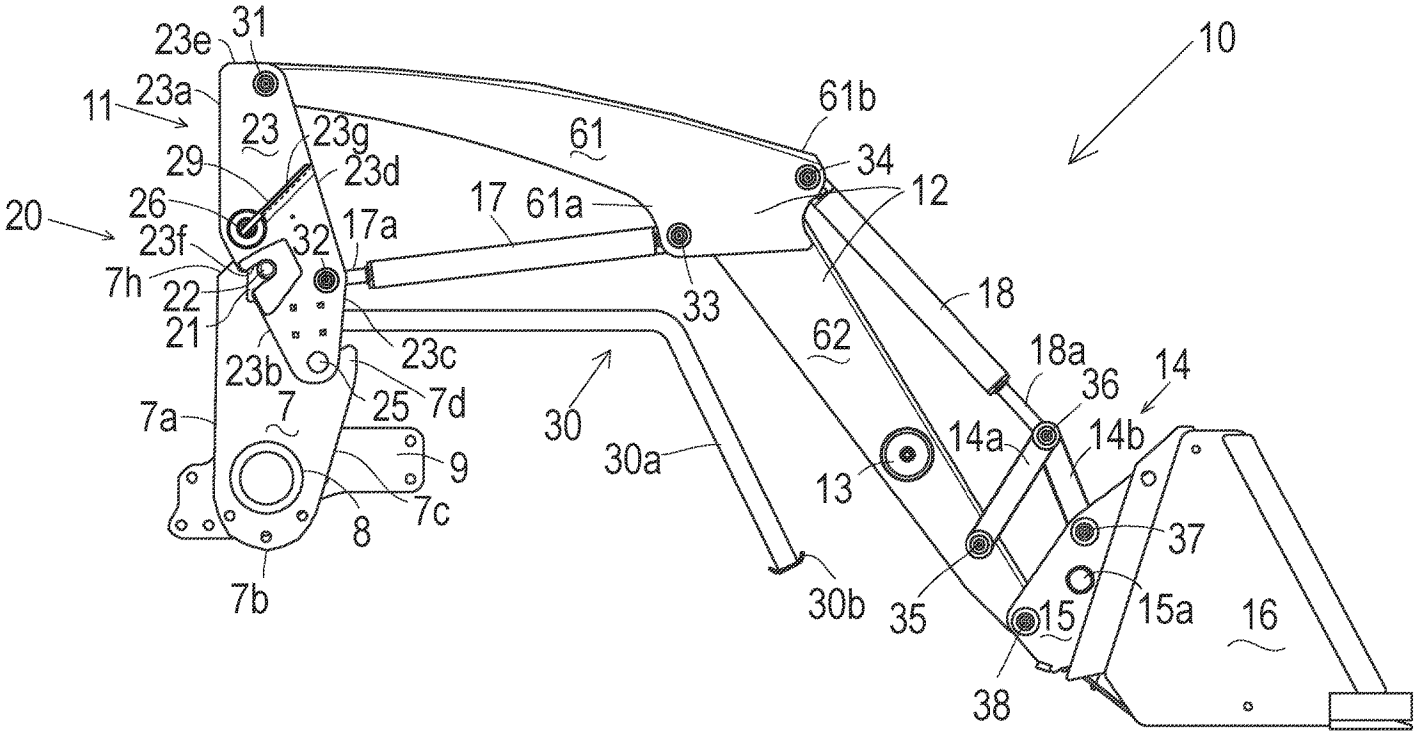
FIG. 5 is a right side view of the front end loader.
Figure 6:
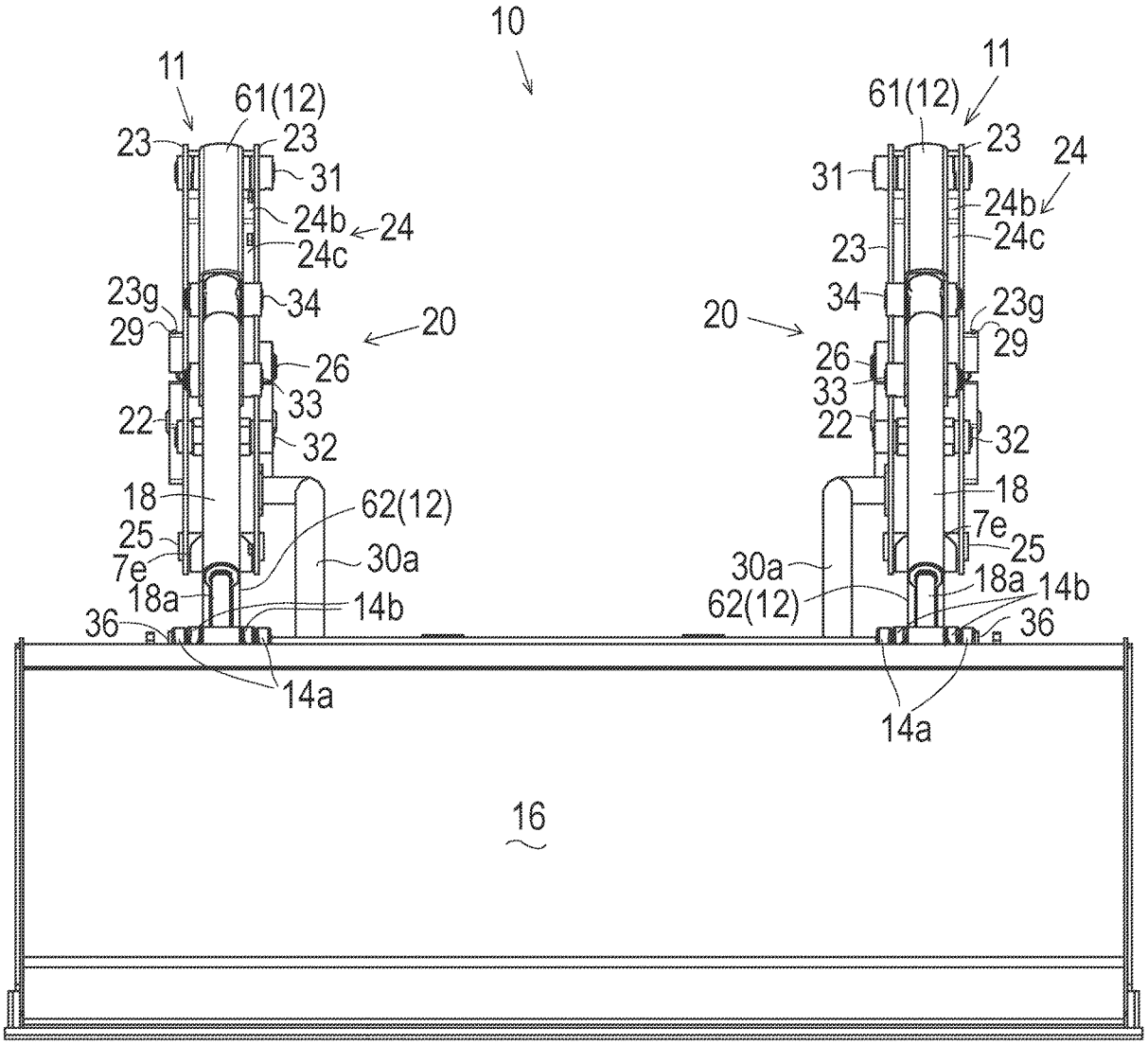
FIG. 6 is a front view of the front end loader.
Figure 7:
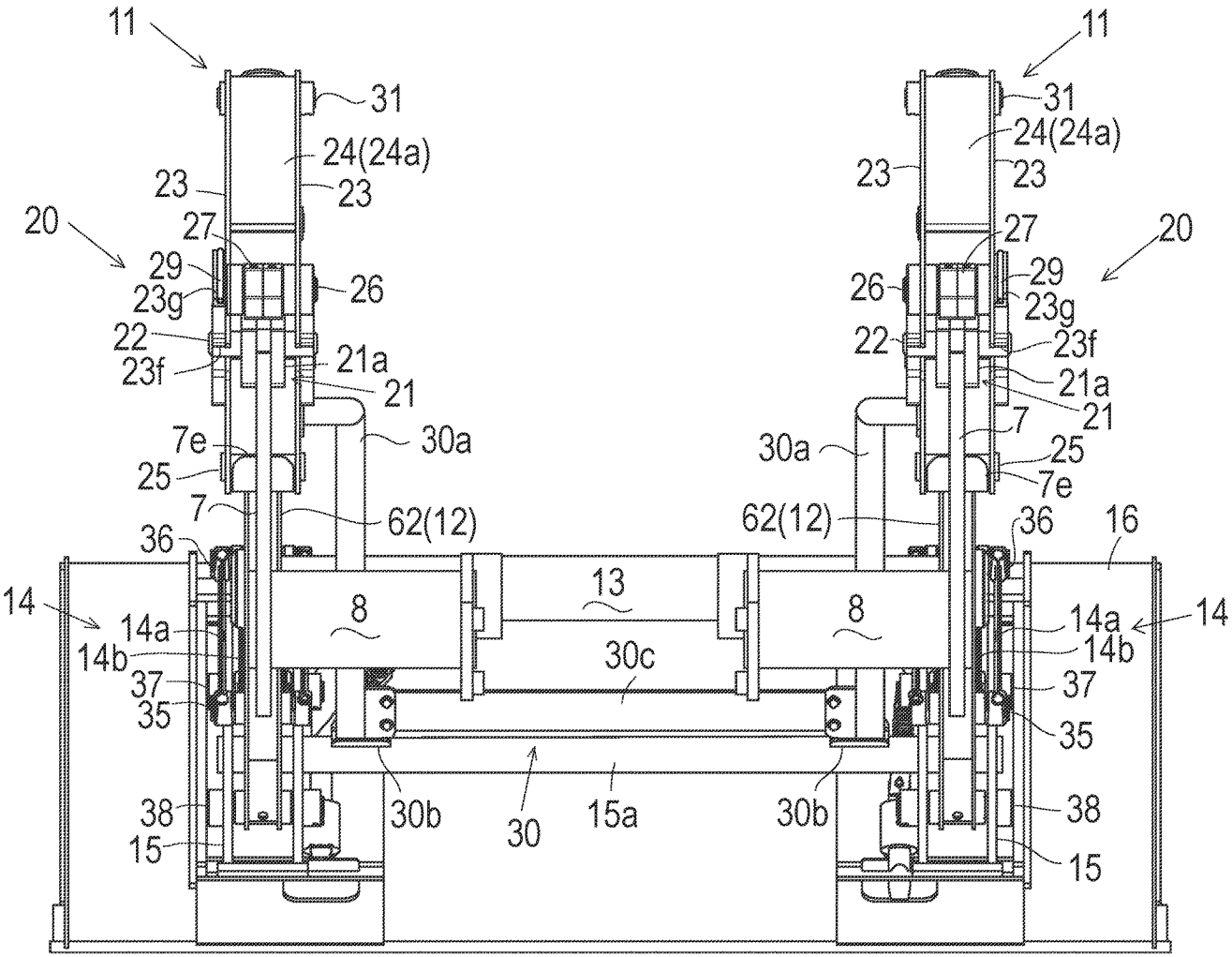
FIG. 7 is a rear view of the font end loader.
Figure 8:
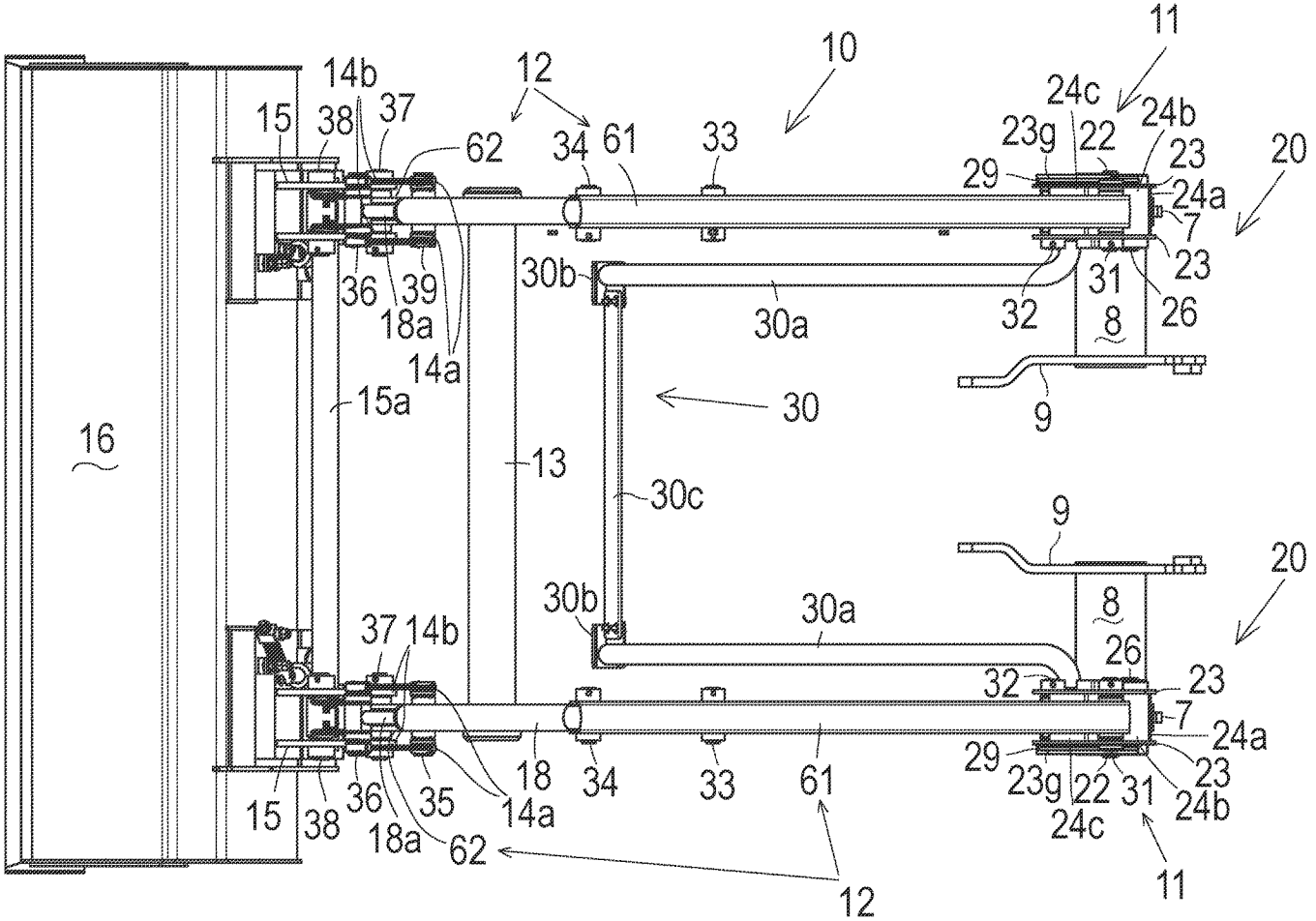
FIG. 8 is a plan view of the front end loader.
Figure 9:
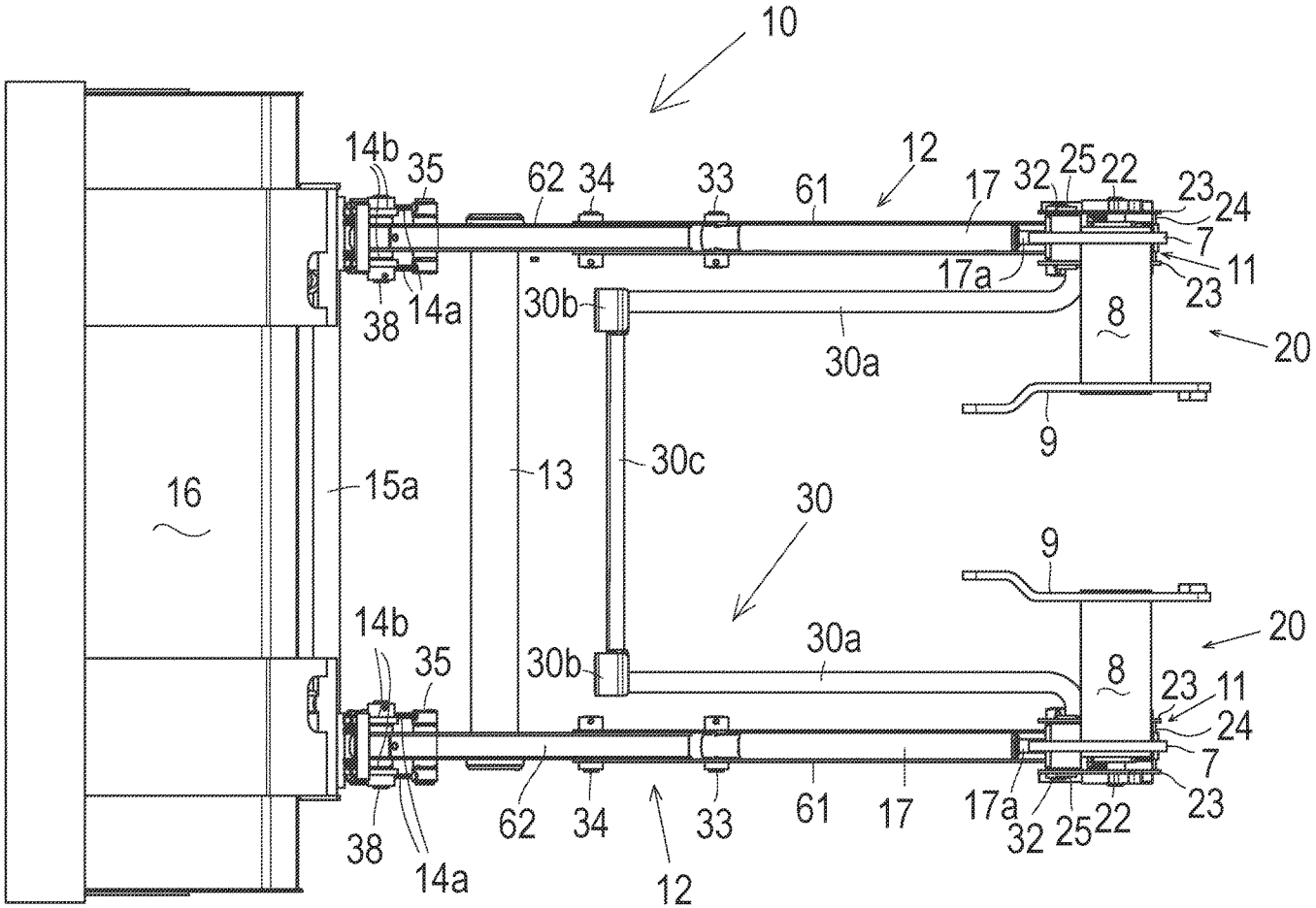
FIG. 9 is a bottom view of the front end loader.

Referring to FIGS. 1 and 2, a tractor equipped with a front loader by a loader attachment system will be described. A tractor 1 includes a vehicle body frame (chassis) 2 having a pair of right and left vertical side plates extended in the fore-and-aft direction of tractor 1. A hood 3 is mounted on a front half portion of vehicle body frame 2 so as to accommodate an engine and so on. A cabin 4 incorporating an operator's seat is mounted on a rear half portion of vehicle body frame 2. A front portion of vehicle body frame 2 supports a pair of right and left front wheels 5. A rear portion of vehicle body frame 2 supports a pair of right and left rear wheels 6.

A pair of right and left loader mounts 7 are fixed on the respective right and left side plates of vehicle body frame 2 immediately forward from a front end of cabin 4 and immediately rearward from respective right and left front wheels 5. More specifically, a stay 9 is stuck to each of the right and left side plates of vehicle body frame 2 and is fastened to the side plate via bolts or so on. A support shaft 8 is extended laterally distally from stay 9. Each loader mount 7 is fixed at a lower portion thereof on a distal end of support shaft 8 so as to be spaced laterally distally from vehicle body frame 2 and hood 3, thereby ensuring a space on each of right and left distal sides of hood 3 for arranging each of right and left parts of a front end loader 10, e.g., each of later-discussed arms 12 and each of later-discussed arm cylinders 17.

Tractor 1 is removably equipped with front end loader 10. Referring to FIGS. 1 to 10, front end loader 10 will be described. Front end loader 10 is an assembly including a pair of right and left masts 11, a pair of right and left arms 12, a connection shaft 13, a pair of right and left bucket links 14, a bucket bracket 15, a bucket 16 serving as a kind of work instrument, a pair of right and left arm cylinders 17, a pair of right and left bucket cylinders 18, and a parking stand 19. The following description of various parts of front end loader 10 will be based on an assumption that bucket 16 attached to front end loader 10 is grounded, i.e., front end loader 10 is lowered to place bucket 16 at its lowest position.

Front end loader 10 is attached to tractor 1 by attaching right and left masts 11 of front end loader 10 to respective right and left loader mounts 7 fixed on vehicle body frame 2 of tractor 1. Each loader mount 7 and corresponding mast 11 attached to loader mount 7 constitute a loader attachment system 20 that will be described in detail later.

Each arm 12 of front end loader 10 includes a rear arm member 61 and a front arm member 62. Rear and front arm members 61 and 62 are joined to each other so as to form boomerang-shaped arm 12. A rear end of each arm 12, i.e., a rear end of each rear arm member 61, is pivoted onto a top portion of each mast 11 via a laterally horizontal pivot shaft 31, so that entire front end loader 10 is vertically rotatable at a front portion thereof centered on right and left pivot shafts 31.

A front portion of rear arm member 61 joined to a rear end portion of front arm member 62 is expanded rearward so as to form an arm cylinder bracket portion 61*a* projecting rearward from the rear end portion of front arm member 62. The front portion of rear arm member 61 joined to the rear end portion of front arm member 62 is also expanded forward so as to form a bucket cylinder bracket portion 61*b* projecting forward to a space above the rear end portion of front arm member 62.

Mast 11 pivotally supports a tip (i.e., rear end) portion of a piston rod 17*a* of arm cylinder 17 on a vertically immediate front end portion thereof via a laterally horizontal pivot shaft 32. Arm cylinder bracket portion 61*a* of arm 12 pivotally supports a basal end (i.e., front end) portion of arm cylinder 17 via a laterally horizontal pivot shaft 33. Right and left arm cylinders 11 serve as actuators for the vertical rotation of entire front loader 10 centered on pivot shafts 31. Piston rods 17*a* of right and left arm cylinders 17 are simultaneously telescopically moved to adjust the vertical rotational angle of front end loader 10, i.e., the angle of right and left arms 12 from masts 11 (fixedly attached to loader mounts 9).

Right and left front arm members 62 are connected and fixed to each other via laterally horizontal connection shaft 13 between their fore-and-aft intermediate portions, so that right and left arms 12 are fixedly integrated with each other. Bucket bracket 15 includes right and left bracket portions integrated with each other via a laterally horizontal connection shaft 15*a*. Right and left front arm members 62 are pivoted onto the respective right and left bracket portions of bucket bracket 15 via respective laterally horizontal pivot shafts 38. Therefore, bucket bracket 15 and bucket 16 fixed to a front end portion of bucket bracket 15 are vertically rotatable centered on right and left pivot shafts 38 relative to right and left arms 12 fixed to each other via connection shaft 13. Alternatively, another work instrument than bucket 16 may be attached to bucket bracket 15.

Each bucket link 14 includes a pair of right and left arm side link members 14*a* and a pair of right and left bucket side link members 14*b*. Right and left arm link members 14*a* are attached at lower end portions thereof to right and left side surfaces of a portion of each front arm member 62 forward from the fore-and-aft intermediate portion of front arm member 62 fixed to connection shaft 13. A laterally horizontal pivot shaft 35 is passed through this portion of each front arm member 62, and the lower end portions of right and left arm side link members 14*a* are fitted on right and left end portions of pivot shaft 35 so as to be pivoted on front arm member 62. A laterally horizontal pivot shaft 37 is provided on an upper portion of each of the right and left bracket portions of bucket bracket 15, and lower end portions of right and left bucket side link members 14*b* are fitted on right and left portions of pivot shaft 37 so as to be pivoted on bucket bracket 15.

Top portions of left arm and bucket side link members 14*a* and 14*b* are fitted onto a left end portion of a laterally horizontal pivot shaft 36, and top portions of right arm and bucket side link members 14*a* and 14*b* are fitted onto a right end portion of pivot shaft 36. A tip (i.e., front end) portion of a piston rod 18*a* of bucket cylinder 18 is fitted on pivot shaft 36 between the top portions of right link members 14*a* and 14*b* and the top portions of left link members 14*a* and 14*b*. Bucket cylinder 18 is pivoted at a basal end (i.e., rear end) portion thereof on bucket cylinder bracket portion 61*b* of rear arm member 61 via a laterally horizontal pivot shaft 34.

Therefore, bucket cylinders 18 serve as actuators for fore-and-aft rotating bucket bracket 15 centered on pivot shafts 31 relative to right and left arms 12. Piston rods 18*a* of bucket cylinders 18 are simultaneously telescopically moved to adjust the bending angle of bucket links 14, i.e., the angle between right and left arm side link members 14*a* and right and left bucket side link members 14*b*, thereby adjusting the fore-and-aft rotational angle of bucket bracket 15 from arms 12.

Further, front end loader 10 is provided with a parking stand 30 below right and left arms 12. Parking stand 30 includes a pair of right and left shaft members 30*a* extended forward from respective right and left masts 11, grounded plates 30*b* fixed on utmost ends of respective right and left shaft members 30*a*, and a connection member 30*c* connecting right and left shaft members 30*a* to each other. Each shaft member 30*a* is bent at an intermediate portion thereof and is extended downward from the bent intermediate portion thereof so as to be fixedly provided at its lower end with grounded plate 30*b*. Connection member 30*c* fixedly connects portions of right and left shaft members 30*a* slightly above grounded plates 30*b*. On the other hand, shaft member 30*a* is extended rearward from the bent intermediate portion thereof so as to be fixed at its rear end to a portion of each mast 11 slightly below pivot shaft 32. Therefore, when right and left masts 11 rotate relative to respective loader mounts 7, parking stand 30 rotates integrally with right and left masts 11.

Loader attachment system 20 including each of right and left loader mounts 7 fixed to tractor 1 and each of right and left masts 11 of front end loader 10 will now be described with reference to FIGS. 1 to 16B.

Figure 10:
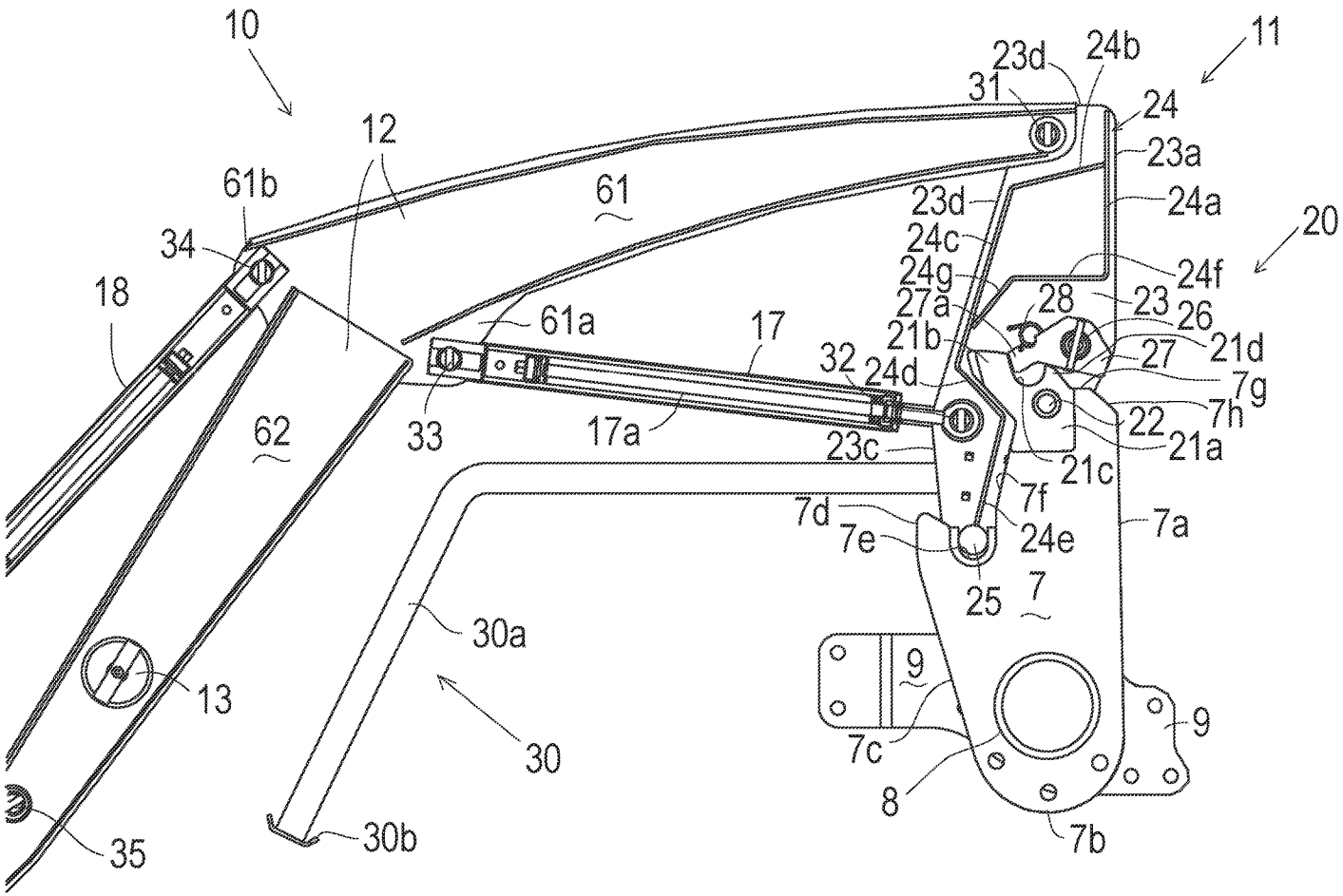
FIG. 10 is a sectional side view of a principal portion of the front end loader including the loader attachment system.
Figure 11:
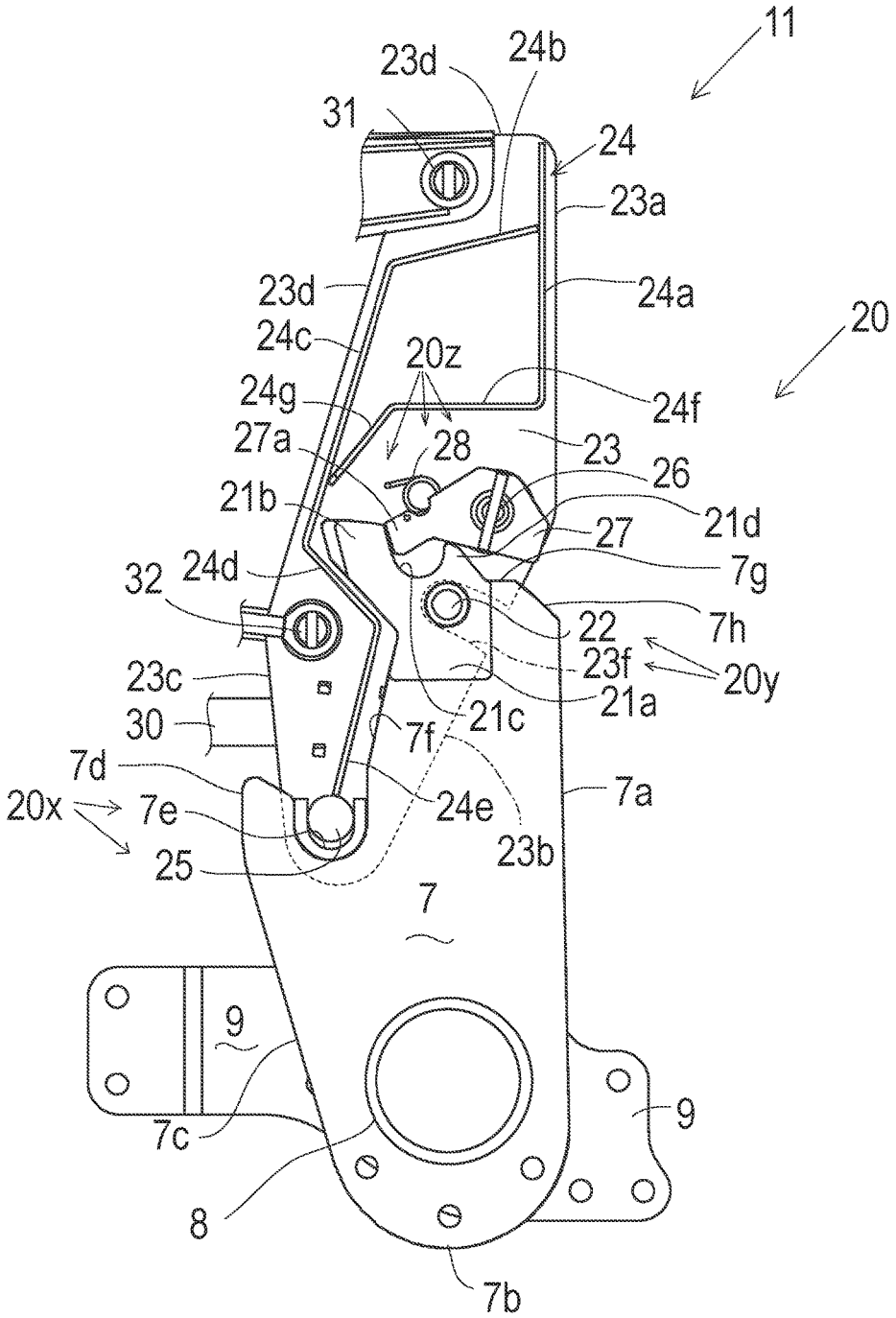
FIG. 11 is an enlarged sectional side view of the loader attachment system.

Loader mount 7 is a vertical plate extended fore-and-aft and vertical directions of tractor 1. A rear end edge 7*a*, a bottom edge 7*b*, a lower front end edge 7*c*, a hook portion 7*d*, a recess 7*e*, an upper front end edge 7*f*, a top edge 7*g*, and an upper rear end edge 7*h* define the contour of loader mount 7 in side view, as shown in FIGS. 10 and 11. Rear end edge 7*a* is extended vertically. Bottom edge 7*b* is extended arcuately forward from a lower end of rear end edge 7*a* so as to surround a lower half portion of an outer peripheral edge of support shaft 8. Lower front end edge 7*c* is extended forwardly upward slantwise from a front end of bottom edge 7*b*. Hook portion 7*d* is formed on a front upper end of lower front end edge 7*c* so as to extend upward. Recess 7*e* is formed in a U-shape when viewed in side rearwardly downward from hook portion 7*d*. Upper front end edge 7*f* is extended rearwardly upward from a bottom end of U-shaped recess 7*d*. Top edge 7*g* is extended horizontally rearward from a rear upper end of upper front end edge 7*f*. Upper rear end edge 7*h* is extended rearwardly downward slantwise from a rear end of top edge 7*g* to an upper end of rear end edge 7*a*. Further, a receptacle 7*e* is formed of a lower-half sleeve-shaped member extended rightward and leftward so as to serve as recess 7*e*.

A locking tooth member 21 is fixed onto an angled portion of loader mount 7 serving as a joint between upper front end edge 7*f* and top edge 7*g*. Locking tooth member 21 is a plate bent in a reverse U-shape when viewed in front so as to form right and left vertical plate portions 21*a*. Right and left vertical plate portions 21*a* are fixedly stuck to respective right and left side surfaces of loader mount 7 by welding or so on. A front upper end portion of locking tooth member 21 is formed as the reverse U-shaped bent portion of loader tooth member 21 so as to serve as a tooth 21*b*. A tooth groove 21*c*, which is U-shaped when viewed in side, is formed on locking tooth member 21 rearward from tooth 21*b*. Further, locking tooth member 21 is formed with an upwardly projecting stopper portion 21*d* rearward from tooth 21*b*. At least one of right and left vertical plate portions 21*a* of each locking tooth plate 21 is formed with a guide pin 22 projecting laterally.

Each mast 11 includes a pair of right and left side plates 23 and a connection plate member 24 interposed between right and left side plates 23. A rear end edge 23*a*, a lower slant edge 23*b*, a lower front end edge 23*c*, an upper slant edge 23*d*, and a top edge 23*e* define the contour of each side plate 23 when viewed in side. Rear end edge 23*b* is extended vertically (when mast 11 is completely attached to loader mount 7). Lower slant edge 23*b* is extended forwardly downward slantwise from a lower end of rear end edge 23*a*. Lower front end edge 23*c* is extended upward from a front end of lower slant edge 23*b* substantially parallel to rear end edge 23*a*. Upper slant edge 23*d* is extended rearwardly upward slantwise from an upper end of lower front end edge 23*c*. top edge 23*e* is extended horizontally rearward from an upper end of upper slant edge 23*d*.

Side plate 23 of mast 11 is formed with an arcuate guide groove 23*f* extended forwardly upward from an upper portion of lower slant edge 23*b* close to the upper end of lower slant edge 23*b*. Guide pin 22 of loader mount 7 is able to enter guide groove 23*f*. Arcuate guide groove 23*f* defines a part of a circle centered on an axis of a pivot shaft 25 provided on mast 11 as discussed later. Arcuate guide groove 23*f* is extended along a locus of guide pin 22 of loader mount 7 during the rotation of mast 11 centered on the axis of pivot shaft 25 fitted in the recess of receptacle 7*e* of loader mount 7 relative to loader mount 7. Each loader mount 7 and mast 11 may have guide pin 22 and guide groove 23*f* on each of right and left sides thereof, or on only one of the right and left sides thereof.

Therefore, receptacle 7*e* of loader mount 7 and pivot shaft 25 of mast 11 constitute a support device 20*x* of loader attachment system 20 configured so as to support mast 11 on loader mount 7 rotatably relative to loader mount 7. Guide pin 22 serving as a projection of loader mount 7 and guide groove 23*f* of mast 11 constitute a location device 20*y* of loader attachment system 20 so as to enable guide pin 22 to move in guide groove 23*f* according to the rotation of mast 11 centered on the axis of pivot shaft 25 relative to loader mount 7.

Connection plate member 24 of mast 11 is formed with an upper rear plate portion 24*a*, an upper intermediate plate portion 24*b*, an upper front plate portion 24*c*, a slant plate portion 24*d*, and a lower plate portion 24*e*. Upper rear plate portion 24*a* is extended along rear end edges 23*a* of side plates 23 from the upper ends of rear end edges 23*a* of side plates 23 to portions of rear end edges 23*a* of side plates 23 slightly higher than the lower ends of rear end edges 23*a*. Upper intermediate plate portion 24*b* is extended slightly downwardly forward from a portion of upper rear plate portion 24*a* slightly lower than the upper end of upper rear plate portion 24*a* to portions of upper slant edges 23*d* of side plates 23 slightly lower than the upper ends of upper slant edges 24*d*. Upper front plate portion 24*c* is extended along upper slant edges 23*d* of side plates 23 forwardly downward from a front end of upper intermediate plate portion 24*b*. Slant plate portion 24*d* is extended rearwardly downward slantwise from a lower end of upper front plate portion 24*c*. Lower plate portion 24*e* is extended downward from a lower end of slant plate portion 24*d*. Connection plate member 24 is further formed with a lower intermediate plate portion 24*f* and a slant plate portion 24*g*. Lower intermediate plate portion 24*f* is extended forward from upper rear plate portion 24*a* below upper intermediate plate portion 24*b*. Slant plate portion 24*g* is extended forwardly downward slantwise from a front end of lower intermediate plate portion 24*f* to a lower end of upper front plate portion 24*c*. Connection plate member 24 interposed between right and left side plates 23 ensures a space between right and left side plates 23 for arranging component members of loader attachment system 20, e.g., a later-discussed locking pawl member 27, and prevents earth and sand from entering the space between right and left side plates 23, thereby protecting the component members in the space between side plates 23.

A lower end of lower slant edge 23*b* and a lower end of lower front end edge 23*c* are joined to each other at a lower end corner portion of each side plate 23. Mast 11 is fixedly provided with laterally horizontal pivot shaft 25 between the lower end corner portions of right and left side plates 23. A lower end of lower plate portion 24*e* of connection plate member 24 is disposed immediately above pivot shaft 25. Pivot shaft 25 is able to fit to receptacle 7*e* of loader mount 7. Lower plate portion 24*e* of connection plate member 24 extended upward from pivot shaft 25 is able to be disposed along upper front end edge 7*f* of loader mount 7 while pivot shaft 25 is fitted to receptacle 7*e*.

An upper end of lower front end edge 23*c* and a lower end of upper slant edge 23*d* are joined to each other at a front end corner portion of each side plate 23. Mast 11 is provided with laterally horizontal pivot shaft 32 interposed between the front end corner portions of right and left side plates 23 so as to have the tip (rear end) portion of piston rod 17*a* of arm cylinder 17 fitted on pivot shaft 32. Connection plate member 24 has a joint between an upper end of lower plate portion 24*e* and a lower end of slant plate portion 24*d*. This joint is disposed immediately rearward from pivot shaft 32. Connection plate member 24 also has a joint between an upper end of slant plate portion 24*d* and a lower end of upper front plate portion 24*c*. This joint is disposed slightly higher than pivot shaft 31. A lower end portion of upper front plate portion 24*c* and slant plate portion 24*d* are able to be disposed along tooth 21*b* of locking tooth member 21 when mast 11 is properly attached to loader mount 7.

An upper end of upper front end edge 23*d* and a front end of top edge 23*e* are joined to each other at an upper end corner portion of each side plate 23. Mast 11 is provided with laterally horizontal pivot shaft 31 interposed between the upper end corner portions of right and left side plates 23 so as to have the rear end portion of rear arm member 61 fitted on pivot shaft 31. Upper intermediate plate portion 24*b* is disposed below the rear end portion of rear arm member 61 pivoted on pivot shaft 31 so as to restrict a lower rotation degree of rear arm member 61, i.e., arm 12, relative to mast 11.

The lower end of rear end edge 23*a* and the upper end of lower slant edge 23*b* are joined to each other at a rear end corner portion of each side plate 23. Mast 11 is provided with a laterally horizontal pivot shaft 26 interposed between the upper end corner portions of right and left side plates 23. Pivot shaft 26 is rotatable centered on its own axis relative to side plates 23. Locking pawl member 27 is fixedly fitted on pivot shaft 26. Locking pawl member 27 is extended from pivot shaft 26 so as to formed at a tip portion thereof with a pawl 27*a*. Lower intermediate plate portion 24*f* is disposed above pivot shaft 26, and slant plate portion 24*g* is disposed forwardly upward from pivot shaft 26. Lower intermediate plate portion 24*f* and slant plate portion 24*g* are spaced from the axis of pivot shaft 26 so as to avoid their interference pawl 27*a* as the tip portion of locking pawl member 27 during rotation of locking pawl member 27 centered on the axis of pivot shaft 26.

Figure 14A:
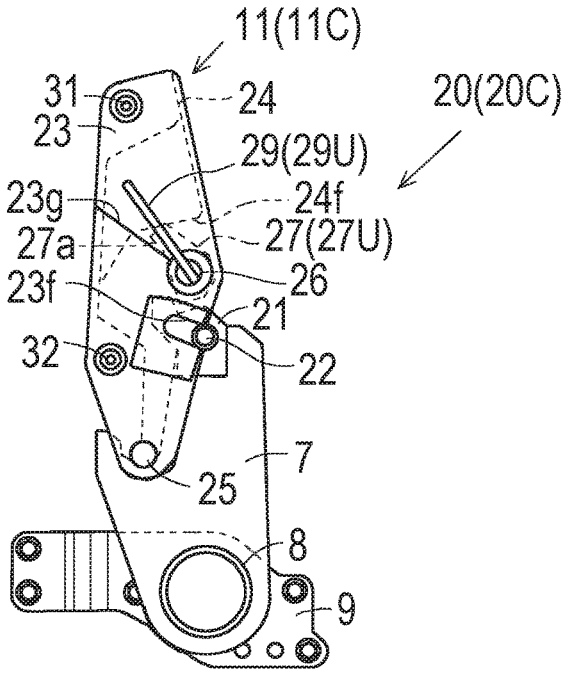
FIG. 14A is a side view of the loader attachment system at a third step of a loader attachment process.
Figure 15A:
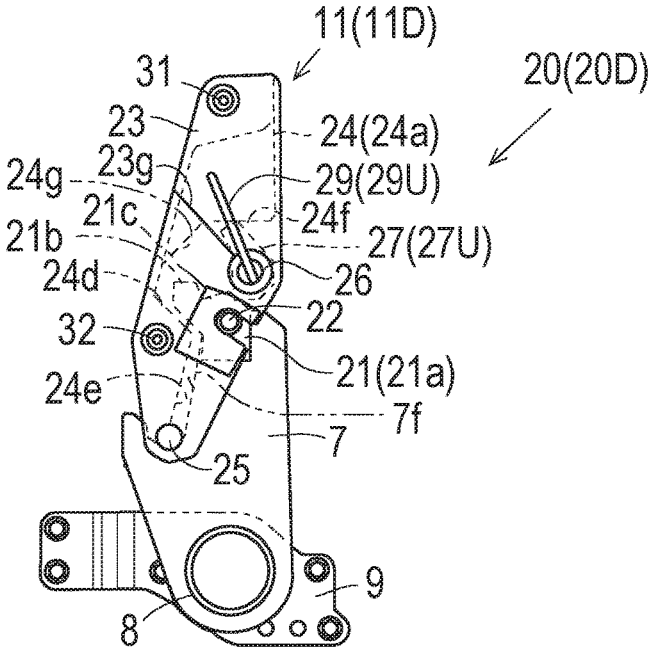
FIG. 15A is a side view of the loader attachment system at a fourth step of a loader attachment process.

Slant plate portion 24*g* of connection plate member 24 is disposed forwardly upward from pivot shaft 26 and has a distance from the axis of pivot shaft 26 so as to avoid its interference with pawl 27*a* of locking pawl member 27 rotating centered on the axis of pivot shaft 26. On the other hand, lower intermediate plate portion 24*f* of connection plate member 24 is disposed above pivot shaft 26 and has a distance from pivot shaft 26 so as to abut against pawl 27*a* of locking pawl member 27 rotating rearwardly upward. In other words, lower intermediate plate portion 24*f* defines a rearward rotation limit position of pawl 27*a*. Referring to FIGS. 14A and 15A, a position of locking pawl member 27 having pawl 27*a* abutting against lower intermediate plate portion 24*f* is defined as a later-discussed unlocking position 27U of locking pawl member 27.

Figure 16A:
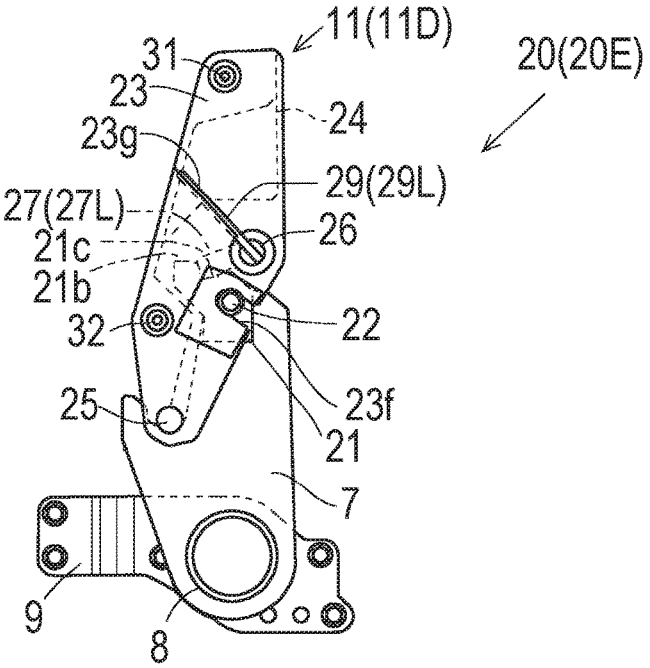
FIG. 16A is a side view of the loader attachment system at a fifth step of a loader attachment process.

One of right and left end portions of pivot shaft 26 projects outward from distal side plate 23 of laterally proximal and distal side plates 23 of each mast 11. A release handle 29 is fixed on the projecting end of pivot shaft 26 and is extended along distal side plate 23. An operator operates release handle 29 with his/her hand so as to rotate release handle 29 forward or rearward, whereby pivot shaft 26 rotates centered on its own axis integrally with release handle 29. Distal side plate 23 is formed with a handle groove 23*g* extended forwardly upward slantwise from the projecting outer end portion of pivot shaft 26. Handle groove 23*g* defines a limit position for the forward rotation of release handle 29. A position of release handle 29 fitted in handle groove 23*g* is defined as a lock position 29L of release handle 29, as shown in FIG. 16A and others.

Preferably, an edge portion of side plate 23 defining handle groove 23*g* may be elastic, so that release handle 29 cannot be inserted into handle groove 23*g* unless release handle 29 is pressed against the edge portion of side plate 23 to expand handle groove 23*g*. Therefore, side plate 23 of mast 11 may have a force to hold release handle 29 at locking position 29L.

A pair of torsion spring 28 are interposed between locking pawl member 27 and respective side plates 23. Torsion spring 28 may be interposed between locking pawl member 27 and at least one side plate 23. When release handle 29 is set at lock position 29L, torsion springs 28 bias locking pawl member 27 in a direction to rotate locking pawl member 27 counterclockwise in the left side view. If mast 11 is completely mounted on loader mount 7, a tip end of pawl 27*a* contacts a rear edge of tooth 21*b* of locking tooth member 21, and torsion spring 28 biases pawl 27*a* in a direction to slide pawl 27*a* rearwardly downward along the rear edge of tooth 21*b*. This biasing force presses a lower portion of locking pawl member 27 against stopper portion 21*d* of a top end of locking tooth member 21. This position of locking pawl member 27 in this state is defined as a lock position 27L of locking pawl member 27.

Therefore, due to the rotation of manipulated release handle 29 to lock position 29L and the biasing force of torsion springs 28 generated by the rotation of locking pawl member 27 along with the rotation of release handle 29, locking pawl member 27 is located at lock position 27L, where pawl 27*a* of locking pawl member 27 is fitted into tooth groove 21*c* of locking tooth member 21 so that locking pawl member 27 and locking tooth member 21 become unrotatable relative to each other. Especially, since torsion springs 28 bias pawl 27*a* rearwardly downward so as to prevent pawl 27*a* from moving forwardly upward in a direction of releasing pawl 27*a* from tooth groove 21*c*, locking pawl member 27 and locking tooth member 21 are locked to each other so that mast 11 is locked to loader mount 7 on which mast 11 is mounted.

When release handle 29 is rotated rearward away from handle groove 23*g*, pivot shaft 26 and locking pawl member 27 rotate rearward following release handle 29, thereby expanding torsion springs 28 between locking pawl member 27 and side plates 23. When release handle 29 starts rotating rearward, torsion springs 28 still bias locking pawl member 27 toward locking position 27L so that a manipulation force has to be applied onto release handle 29 against the biasing force of springs 28. However, once the rearward rotation degree of release handle 29 from handle groove 23*g* reaches a certain degree, torsion springs 28 perform their overcenter action, and then, torsion springs 28 bias locking pawl member 27 clockwise in the left side view (this direction is defined as "unlocking direction"). This biasing direction coincides to the direction of the manipulation force applied to release handle 29 to rotate release handle 29 rearward. Therefore, once spring 29 performs the overcenter action, the manipulation force required for rotating release handle 29 is suddenly lightened. In other words, once release handle 29 rotates rearward to reach the position where torsion springs 28 perform the overcenter action, locking pawl member 27 rotates in the unlocking direction due to only the biasing force of torsion springs 28 instead of the manipulation force applied onto release handle 29, so that locking pawl member 27 finally reaches unlocking position 27U defined by lower intermediate plate portion 24*f* of connection plate member 24 as mentioned above.

Incidentally, the setting of position for the overcenter action of torsion springs 28 determines how far locking pawl member 27 should be moved in the unlocking direction by the manipulation force applied onto release handle 29. If the releasing of locking pawl member 27 from locking tooth member 21 is desired to rely on only the manipulation force, the position for overcenter action of springs 28 should be set so that the overcenter action occurs after pawl 27*a* is completely removed from tooth groove 21*c*. If the position for overcenter action of springs 28 is set so that the overcenter action occurs on the way of movement of pawl 27*a* in tooth groove 21*c*, the manipulation force to be applied on release handle 29 is required for only the slight movement of pawl 27*a*, and the removal of pawl 27*a* from tooth groove 21*c*, i.e., the disengagement of locking pawl member 27 from locking tooth member 21, depends on the biasing force of springs 28. Wherever the position of overcenter action of springs 28 may be set, mast 11 is unlocked from loader mount 7 so as to be rotatable centered on the axis of pivot shaft 25 forward relative to loader mount 7 as long as rearwardly rotated release handle 29 reaches the position for overcenter action of springs 28.

Finally, locking pawl member 27 biased in the unlocking direction by springs 28 is located at unlocking position 27U defined by lower intermediate plate portion 24*f* as mentioned above. Referring to FIGS. 14A and 15A, the position of release handle 29 when locking pawl member 27 is disposed at unlocking position 27U is defined as an unlocking position 29U of release handle 29. Unlocking position 29U is not a place that manipulated release handle 29 should reach to release locking pawl member 27 from locking tooth member 21 but is a place that release handle 29 naturally reaches when locking pawl member 27 followed by release handle 29 reaches unlocking position 27U. In other words, to shift locking pawl member 27 from locking position 27L to unlocking position 27U, the manipulation force has to be applied on release handle 29 for only the rearward rotation range of release handle 29 from locking position 29L to the position for overcenter action of springs 28, while release handle 29 naturally rotates by the biasing force of springs 28 in the rearward rotation range from the position for overcenter action of springs 28 to unlocking position 29U.

On the contrary, to shift locking pawl member 27 from unlocking position 27U to locking position 27L, the manipulation force has to be applied onto release handle 29 to rotate release handle 29 forward from unlocking position 29U to the position for overcenter action of springs 28 because the forward rotation of locking pawl member 27 from unlocking position 27U to the position for overcenter action of springs 28 is opposite the biasing direction of springs 28. Once sprigs 28 perform the overcenter action, springs 28 bias locking pawl member 27 toward locking position 27L. Due to this biasing force of springs 28, locking pawl member 27 naturally rotates to reach locking position 27L to engage with locking tooth member 21. Since this biasing direction of springs 28 coincides to the forward rotation direction of release handle 29, release handle 29 reaches locking position 29L without the manipulation force naturally when locking pawl member 27 reaches locking position 27L.

As mentioned above, locking tooth member 21 of loader mount 7 with tooth 21*b*, locking pawl member 27 of mast 11 with pawl 27*a*, overcenter torsion springs 28 interposed between mast 11 and locking pawl member 27, and release handle 29 fixed on pivot shaft 26 serving as the fulcrum for rotation of locking pawl member 27 constitute an engagement device 20*x* of loader attachment system 20 for locking mast 11 to loader mount 7 when locking mast 11 is completely mounted on loader mount 7.

Incidentally, at least distal side plate 23 of proximal and distal side plates 23 of mast 11 is made of a transparent or semitransparent member so that locking pawl member 27 disposed inside of mast 11 between proximal and distal side plates 23 is visible from the distal outside of mast 11. Therefore, a person who stands on the laterally distal side of mast 11 to manipulate release handle 29 can see the inside of mast 11 through transparent or semitransparent distal side plate 23 so as to confirm whether locking pawl member 27 in mast 11 is disposed at locking position 27L or unlocking position 27U.

An attachment process to attach front end loader 10 to tractor 1, i.e., to attach right and left masts 11 of front end loader 10 to respective right and left loader mounts 7 of tractor 1, will be described with reference to FIGS. 12A to 16B.

Figure 12A:
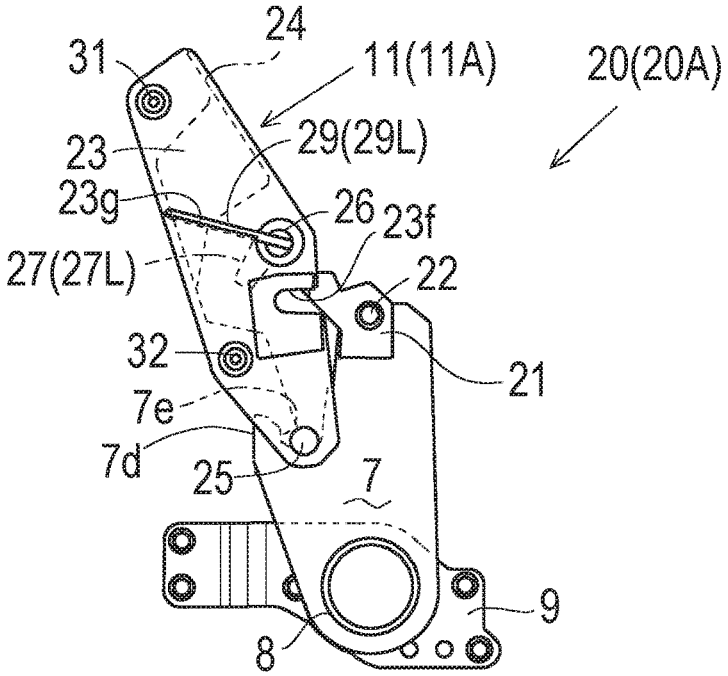
FIG. 12A is a side view of the loader attachment system at a first step of a loader attachment process.
Figure 12B:
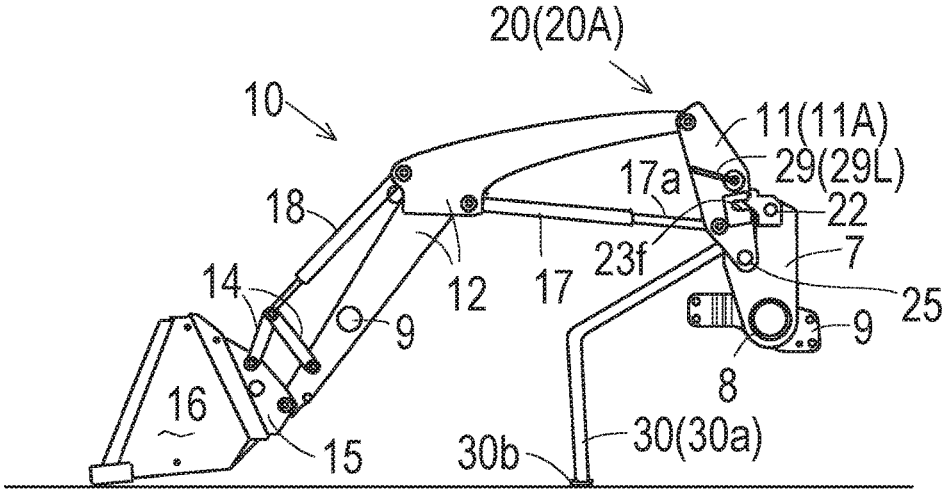
FIG. 12B is a side view of the front end loader at the first step.

Before starting this process, front end loader 10 is placed so as to have bucket 16 and parking stand 30 (i.e., grounded plates 30*b*) placed on the ground by their gravity, as shown in FIG. 12B. In this state, mast 11 is rather slanted forwardly upward. Tractor 1 approaches placed front end loader 10 so that masts 11 approach respective loader mounts 7. At least right and left arm cylinders 17 of right and left cylinders 17 and 18 are fluidly connected to tractor 1 via hydraulic fluid pipes for operating the telescopic action of piston rods 17*a*.

In the condition that loader mount 7 are disposed adjacently rearward of respective masts 11, tractor 1 is stationary. An operator seated in cabin 4 operates to extend piston rods 17*a* of arm cylinders 17, for instance, to move the lower end portions of masts 11 rearward, whereby pivots 25 get over hook portions 7*d*, and then are fitted into the arcuate recesses defined by respective receptacles 7*e* disposed rearward from respective hook portions 7*d*. Referring to FIGS. 12A and 12B, a state of each loader attachment system 20 where pivot shaft 25 starts fitting to receptacle 7*e* is defined as a first staged state 20A of loader attachment system 20. In this state, a rotational position of each mast 11 relative to loader mount 7 is defined as a first rotational position 11A. At first rotational position 11A, each mast 11 of front end loader 10 is extended forwardly upward slantwise.

Locking pawl members 27 and release handles 29 may be previously set at unlocking positions 27U and 29U before each of loader attachment systems 20 is set in first staged state 20A as shown in FIGS. 12A and 12B. However, this embodiment will be described on an assumption that locking pawl member 27 and release handle 29 are set at locking positions 27L and 29L while loader attachment system 20 transfers from first staged state 20A as shown in FIGS. 12A and 12B to a second staged state 20B as shown in FIGS. 13A and 13B.

First staged state 20A of loader attachment system 20 shown in FIGS. 12A and 12B means a state where pivot shaft 25 of each mast 11 and receptacle 7*e* of each loader mount 7 start fitting each other so that support device 20*x* of loader attachment system 20 starts its function. Once each of masts 11 is located at first rotational position 11A relative to loader mount 7 so as to fit pivot shaft 25 to receptacle 7*e* by extending pivot rods 17*a* of arm cylinders 17 as mentioned above, then, the operator seated in cabin 4 operates to contract piston rods 17*a* of arm cylinders 17. Accordingly, bucket 16, while being grounded by its gravity, slides rearward on the ground so that right and left masts 11 rotate rearward relative to respective loader mounts 7 so as to reduce an angle between each arm 12 and each mast 11. During this reduction of angle between arm 12 and mast 11, each pivot shaft 25 rotates centered on its own axis, and each receptacle 7*e* allows pivot shaft 25 to slidably rotate thereon. In other words, support device 20*x* functions to rotate mast 11 relative to loader mount 7. In this way, each mast 11 rotates centered on the axis of pivot shaft 25 clockwise in the left side view, whereby parking stand 30 is raised so that grounded plates 30*b* rise apart from the ground.

Figure 13A:
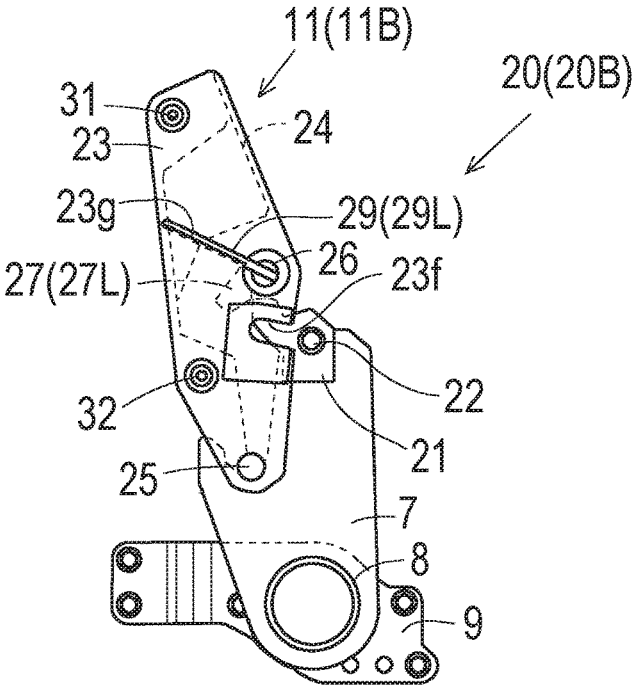
FIG. 13A is a side view of the loader attachment system at a second step of a loader attachment process.
Figure 13B:
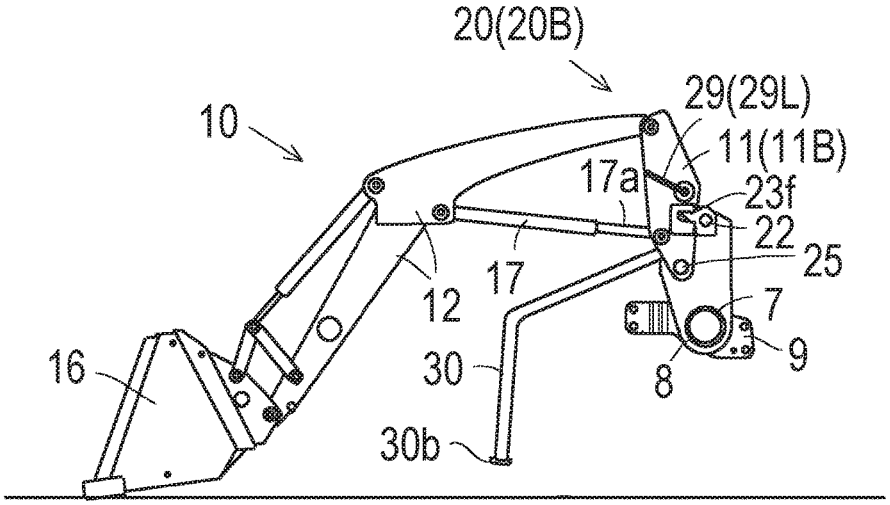
FIG. 13B is a side view of the front end loader at the second step.

Then, each loader attachment system 20 transfers to second staged state 20B as shown in FIGS. 13A and 13B. In this state, mast 11 reaches a second rotational position 11B of mast 11 relative to loader mount 7, where an inlet of guide groove 23*f* of mast 11 is disposed adjacent to guide pin 22. In mast 11 reaching second rotational position 11B, locking pawl member 27 at locking position 27L abuts against a front end of tooth 21*b* of locking tooth member 21. Therefore, mast 11 cannot rotate rearward relative to loader mount 7 further from second rotational position 11B unless locking pawl member 27 is shifted to unlocking position 27U.

In this way, the operator notices that the state of each loader attachment system 20 in the attachment process becomes second staged state 20B so that piston rods 17*a* cannot be contracted further to rotate masts 11. Therefore, the operator stops the operation to contract piton rods 17*a*. Then, the operator getting out of cabin 4 or another person having been close to tractor 1 outside of cabin 4 rotates release handle 29 of each of right and left masts 17 from locking position 29L to unlocking position 29U so as to shift locking pawl member 27 to unlocking position 27U due to the overcenter action of springs 28. In this way, engagement device 20*z* is operated for unlocking.

As mentioned above, second staged state 20B of loader attachment system 20 is defined to make the operator notice that release handles 29 should be rotated from respective locking positions 29L. Also, since mast 11 at second rotational position 11B has the inlet of guide groove 23*f* adjacent to guide pin 22, second staged state 20B of loader attachment system 20 is defined to interrupt the rotation of mast 11 so as to give the operator a time for confirming if mast 11 is ready for sure entrance of guide pin 22 into guide groove 23*f*, i.e., if loader attachment system 20 is prepared for its next stage in the attachment process where location device 20*y* can start its proper function.

Figure 14B:
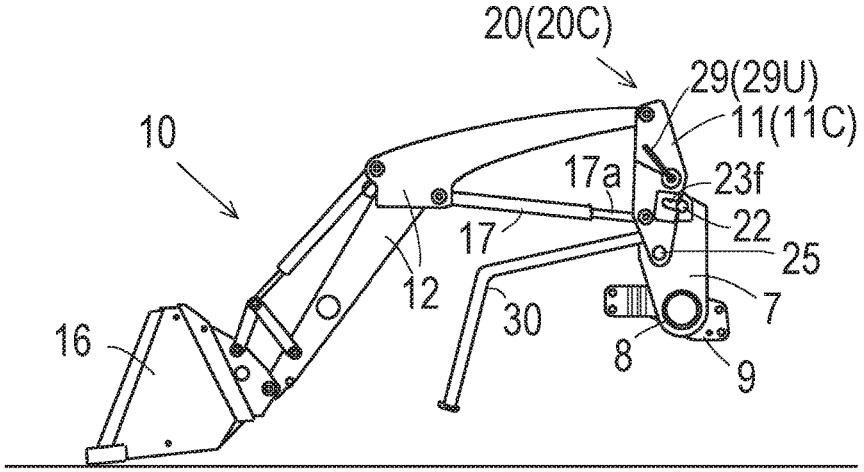
FIG. 14B is a side view of the front end loader at the third step.

Once release handle 29 of each loader attachment system 20 in second staged state 20B is shifted to unlocking position 29U, then, the operator seated in cabin 4 operates again to further contract piston rods 17*a* of right and left arm cylinders 17 so as to rotate masts 11 further rearward from their second rotational positions 11B, whereby each loader attachment system 20 transfers to a third staged state 20C as shown in FIGS. 14A and 14B. In third staged state 20C of loader attachment system 20, mast 11 rotating rearward relative to loader mount 7 reaches a third rotational position 11C, where guide pin 22 arrives at the inlet of guide groove 11. In other words, location device 20*y* starts its function, so that, afterward, the further rearward rotation of mast 11 relative to loader mount 7 by further contracting piston rod 17*a* makes guide pin 22 move in guide groove 23*f* toward the deep end of guide groove 23*f*.

Figure 15B:
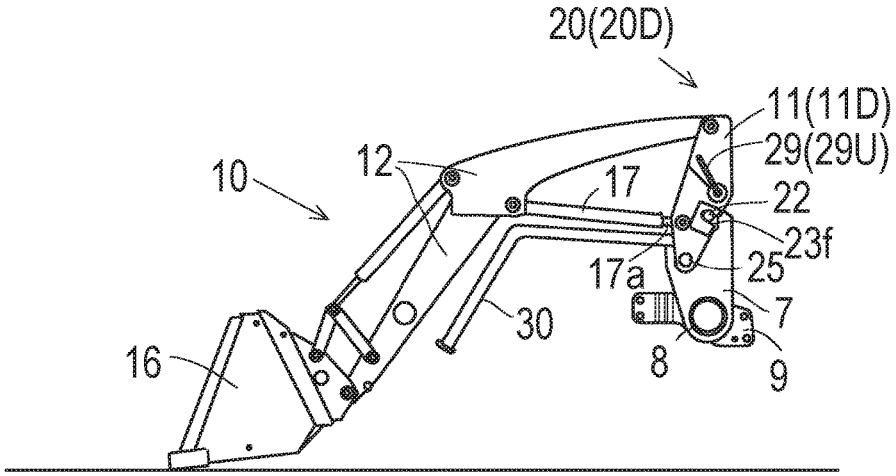
FIG. 15B is a side view of the front end loader at the fourth step.

Finally, mast 11 rotating rearward relative to loader mount 7 by contracting piston rod 17*a* reaches a fourth rotational position 11D as shown in FIGS. 15A and 15B, where guide pin 22 reaches the deep end of guide groove 23*f* so that guide pin 22 cannot move further in guide groove 23*f*, i.e., mast 11 cannot rotate further rearward relative to loader mount 7. Therefore, the operator notices that piston rods 17*a* cannot be further contracted, thereby noticing that masts 11 reach respective proper mounting positions on loader mounts 7. In other words, fourth rotational position 11D is the proper mounting position of mast 11 on loader mount 7. Therefore, the arrival of mast 11 at fourth rotational position 11D means that location device 20*y* finishes its function to locate mast 11 at the proper mounting position on loader mount 7.

Incidentally, in this embodiment, mast 11 located at fourth rotational position 11D as the proper mounting position is illustrated as having rear end edges 23*a* of side plates 23 and upper rear plate portion 24*a* of connection plate member 24 approximately arranged on a vertical plane defined by rear end edge 7*a* of loader mount 7 (see FIGS. 10 and 11). However, this is an exemplificative attitude of mast 11 at the proper mounting position. Mast 11 at the proper mounting position may have any attitude.

In this way, the operator notices the arrival of masts 11 at their proper mounting positions relative to loader mounts 7, and then, stops the operation to contract piston rods 17*a* of arm cylinders 17. At this stage, locking pawl members 27 and release handles 29 are still placed at unlocking positions 27U and 29U. FIGS. 15A and 15B illustrate such a state of loader attachment system 20 as a fourth staged state 20D of loader attachment system 20.

Figure 16B:
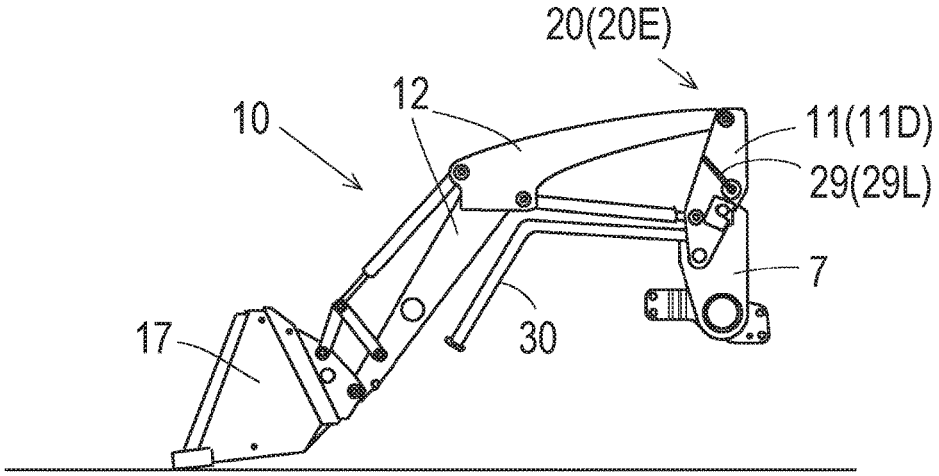
FIG. 16B is a side view of the front end loader at the fifth step.

Then, the operator getting out of cabin 4 or another person rotates release handles 29 of respective right and left masts forward from unlocking position 29U, and fit release handles 29 into respective handle grooves 23*g*, thereby setting release handles 29 at respective locking positions 29L as shown in FIGS. 16A and 16B. Each of torsion springs 28 performs the overcenter action on the way of forward rotation of corresponding release handle 29, so that locking pawl member 27 having been biased toward unlocking position 27U comes to be biased toward locking position 27L. With regard to mast 11 at fourth rotational position 11D as the proper mounting position, tooth groove 21*c* of locking tooth member 21 of loader mount 7 is just disposed on a locus of pawl 27*a* of locking pawl member 27 rotating counterclockwise in the left side view, whereby pawl 27*a* is fitted into tooth groove 21*c* by shifting release handle 29 to locking position 29L. Stopper portion 21*d* abuts against locking pawl member 27 so as to prevent locking pawl member 27 from further rotating by the biasing force of springs 28, thereby locating locking pawl member 27 at locking position 27L, where locking pawl member 27 engages with locking tooth member 21. Therefore, the engagement of locking pawl member 27 with locking tooth member 21 means that engagement device 20*z* finishes its locking function to lock mast 11 to loader mount 7.

FIGS. 16A and 16B illustrate a fifth staged state 20E of loader attachment system 20, where release handle 29 is set at locking position 29L so as to place locking pawl member 27 at locking position 27L to engage with locking tooth member 21 while mast 11 is disposed at fourth rotational position 11D. Fifth staged state 20E of loader attachment system 20 means that front end loader 10 is completely attached to tractor 1. Afterward, the operator in cabin 4 can operate to telescopically move piston rods 17*a* of arm cylinders 17 and/or piston rods 18*a* of bucket cylinders 18 so as to optionally change the position or attitude of bucket 16.

Incidentally, in the above-mentioned attachment process, locking pawl members 27 and release handles 29 are previously set at locking positions 27L and 29L so that the stopping of contraction of piston rods 17*a*, i.e., the stopping of rotation of masts 11, makes the operator notice that the state of each loader attachment system 20 becomes second staged state 20B where the inlet of guide groove 23*f* comes close to guide pin 22. Alternatively, as mentioned above, locking pawl members 27 and release handles 29 may be previously set at unlocking positions 27U and 29U. In this case, each mast 11 can be rotated without interruption from first rotational position 11A, where pivot shaft 25 starts fitting to receptacle 7*e*, to fourth rotational position 11D, where guide pin 22 abuts against the deep end of guide groove 23*f*. Therefore, release handles 29 does not have to be manipulated on the way of the attachment process so as to rotate release handles 29 from locking positions 29L to unlocking positions 29U. However, this case may depend on a condition that guide pin 22 surely enters guide groove 23*f* without deviation from guide groove 23*f* even if the rotation of mast 11 is not stopped immediately before guide pin 22 enters guide groove 23*f*.

A detachment process to detach each mast 11 from each loader mount 7 is performed by transference of loader attachment system 20 from fifth staged state 20E as the complete attachment state of front end loader 10 to tractor 1 to first staged state 20A, which is a reverse course of the attachment process. In this regard, bucket 16 of front end loader 10 is grounded, and then, release handles 29 are shifted to unlocking positions 29U so as to shift locking pawl member 27 to unlocking position 27U to disengage from locking tooth member 21, thereby setting each loader attachment system 20 at fourth staged state 20D. Then, piston rods 17*a* of arm cylinders 17 are extended so as to rotate each mast 11 forward relative to loader mount 7 from fourth rotational position 11D to first rotational position 11A. During the extension of piston rods 17*a*, parking stand 30 is lowered. Finally, when each mast 11 reaches first rotational position 11A, grounded plates 30*b* of parking stand 30 reach the ground. Until this stage, locking pawl members 27 and release handles 29 are held at unlocking positions 27U and 29U, and the forward rotation of masts 11 are not interrupted. After each mast 11 reaches first rotational position 11A and parking stand 30 is grounded, tractor 1 is slightly backed, for example, so as to remove pivot shafts 25 of masts 11 forward from hook portions 7*d* of loader mount 7, thereby completing the detachment of front end loader 10 from tractor 1.

It is further understood by those skilled in the art that the foregoing description is given to preferred embodiments of the disclosed apparatus and that various changes and modifications may be made in the invention without departing from the scope thereof defined by the following claims. For example, in the above-mentioned embodiment, loader attachment system 20 is adapted for attaching front end loader 10 to tractor 1. Alternatively, loader attachment system 20 is adaptable for attaching a backhoe serving as a loader to a vehicle, e.g., a tractor.

What is claimed is:

1. A loader attachment system comprising:
- a loader mount configured to be fixed on a vehicle;
- a mast configured to be coupled to a loader and detachably attached to the loader mount;
- a support device configured to support the mast on the loader mount such that the mast is rotatable relative to the loader mount;
- a location device configured to position the mast and the loader mount at an attachment position; and
- an engagement device comprising:
  - a tooth provided on the loader mount;
  - a pawl coupled to the mast, the pawl configured to rotate about a pivot shaft;
  - an overcenter torsion spring interposed between the pawl and the mast, the overcenter torsion spring coupled to the mast at a location of the mast and coupled to the pawl at a location of the pawl; and
  - a release handle coupled to the pawl such that the pawl and the release handle are rotatably centered on a common axis of the pivot shaft;
- wherein:
  - the release handle is rotatable from a lock position to engage the pawl with the tooth;
  - the overcenter torsion spring is configured to bias the pawl in a first direction to engage the pawl with the tooth when the pawl is engaged with the tooth; and
  - based on rotation of the release handle from the lock position:
    - the pawl rotates about the common axis; and
    - the overcenter torsion spring changes a direction of its force to bias the pawl in a second direction to rotate the pawl away from the tooth.

2. The loader attachment system according to claim 1, wherein:
- the support device comprises:
  - a pivot serving as a fulcrum of the rotation of the mast relative to the loader mount; and
  - a receptacle receiving the pivot,
  - wherein one of the loader mount and the mast includes the pivot, and the other of the loader mount and the mast includes the receptacle, and
- the location device comprises:
  - a projection; and
  - a groove extended along a locus of the projection during the rotation of the mast relative to the loader mount,
  - wherein:
    - one of the loader mount and the mast includes the projection, and the other of the loader mount and the mast includes the groove,
    - the rotation of the mast about the pivot relative to the loader mount moves the projection into the groove, and
    - the location device is configured to position the mast and the loader mount to an attachment position where the projection abuts a bottom of the groove.

3. The loader attachment system according to claim 1, wherein, when the mast is attached to the loader mount, the release handle is disposed outside of the mast.

4. The loader attachment system according to claim 3, further comprising:
- a loader attached to the mast; and
- wherein, when the mast is attached to the loader mount, the loader is disposed forward or rearward from the vehicle, and the lock position is forward or rearward close to the loader so that the rotation direction of the release handle from the lock position is forward or rearward away from the loader.

5. A loader attachment system comprising:
- a loader mount configured to be coupled to a vehicle, the loader mount comprising:
  - a mount body defining a receptacle;
  - a guide pin that projects from the mount body; and
  - a locking tooth member coupled to the mount body; and
- a mast configured to be removably coupled to a loader, the mast comprising:
  - a mast body having a guide groove that defines a recess in the mast, the guide groove configured to receive the guide pin;
  - a first pivot shaft that projects from the mast body and is configured to engage the receptacle of the loader mount such that the first pivot shaft acts as a fulcrum between the mast and the loader mount;
  - a pawl coupled to the mast body, the pawl configured to rotate about a second pivot shaft;
  - an overcenter torsion spring coupled to the pawl; and
  - a release handle coupled to the pawl and configured to connectively rotate with the pawl about a common axis of the second pivot shaft, the release handle rotatable to a lock position to engage the pawl with the locking tooth member.

6. The loader attachment system of claim 5, wherein:

the mast body comprises:

a left mast plate; and a right mast plate.

7. The loader attachment system of claim 6, wherein the first pivot shaft extends from the left mast plate to the right mast plate.

8. The loader attachment system of claim 7, wherein the pawl and the overcenter torsion spring disposed between the left mast plate and the right mast plate.

9. The loader attachment system of claim 6, wherein:

the mast body comprises a lower intermediate plate portion disposed between the left mast plate and the right mast plate;

the release handle is rotatable to an unlock position to engage the pawl with the lower intermediate plate portion of the mast body; and when the pawl engages with the lower intermediate plate portion, the overcenter torsion spring biases the pawl in a direction to engage the pawl with the lower intermediate plate portion.

10. The loader attachment system of claim 5, wherein the locking tooth member comprises a tooth.

11. The loader attachment system of claim 10, wherein, when the pawl engages with the tooth, the overcenter torsion spring biases the pawl in a direction to engage the pawl with the tooth so as to prevent the mast from rotating in a direction to detach the mast from the loader mount.

12. The loader attachment system of claim 10, wherein, when the release handle is rotated from the lock position to an unlock position, the pawl rotates around the second pivot shaft, past an overcenter position where the overcenter torsion spring changes a direction of its force so as to bias the pawl in another direction to rotate the pawl apart from the tooth, thereby keeping the pawl disengaged from the tooth.

13. The loader attachment system of claim 10, wherein:

the locking tooth member comprises a stopper portion; and the pawl comprises a pawl tip.

14. The loader attachment system of claim 13, wherein, when the pawl engages with the tooth, the pawl tip contacts a top portion of the tooth and the stopper portion contacts a bottom portion of the pawl tip to prevent the pawl from rotating toward a bottom portion of the tooth.

15. The loader attachment system of claim 5, wherein:

an overcenter position where the overcenter torsion spring changes a direction of its bias force can be set to a first position and a second position; and the release handle is required to rotate further to reach the overcenter position when the overcenter position is at the first position than when the overcenter position is at the second position.

16. The loader attachment system of claim 5, wherein the overcenter torsion spring is coupled to the pawl at a location on the pawl and is coupled to the mast at a location on the mast.

17. The loader attachment system of claim 16, wherein, when the release handle is in a lock position, the location on the pawl is positioned between a portion of the pawl configured to engage the locking tooth member and the axis of the second pivot shaft.

18. A loader attachment comprising:

a mast configured to be removably coupled to a loader, the mast comprising:

a mast body having a guide groove that defines a recess in the mast, the guide groove configured to receive a guide pin that projects from a mount body of a loader mount that is configured to be coupled to a vehicle;

a first pivot shaft that projects from the mast body and is configured to engage a receptacle defined in the mount body of the loader mount such that the first pivot shaft acts as a fulcrum between the mast and the loader mount;

a pawl coupled to the mast body, the pawl configured to rotate about a second pivot shaft;

an overcenter torsion spring coupled to the pawl; and a release handle coupled to the pawl and configured to connectively rotate with the pawl about a common axis of the second pivot shaft, the release handle and the pawl configured to rotate about the second pivot shaft to enable the pawl to engage a locking tooth member of the mount body.

* * * * *